US009275644B2

(12) United States Patent
Rajendran et al.

(10) Patent No.: US 9,275,644 B2
(45) Date of Patent: Mar. 1, 2016

(54) DEVICES FOR REDUNDANT FRAME CODING AND DECODING

(71) Applicant: Qualcomm Incorporated, San Diego, CA (US)

(72) Inventors: Vivek Rajendran, San Diego, CA (US); Venkatesh Krishnan, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 479 days.

(21) Appl. No.: 13/743,797

(22) Filed: Jan. 17, 2013

(65) Prior Publication Data

US 2013/0191121 A1 Jul. 25, 2013

Related U.S. Application Data

(60) Provisional application No. 61/589,103, filed on Jan. 20, 2012, provisional application No. 61/661,245, filed on Jun. 18, 2012.

(51) Int. Cl.

| | |
|---|---|
| ***G10L 21/02*** | (2013.01) |
| ***G10L 19/00*** | (2013.01) |
| ***G10L 19/22*** | (2013.01) |
| ***G10L 19/005*** | (2013.01) |
| *G10L 19/10* | (2013.01) |
| *G10L 19/12* | (2013.01) |
| *G10L 19/09* | (2013.01) |
| *G10L 25/21* | (2013.01) |

(52) U.S. Cl.

CPC ..... *G10L 19/00* (2013.01); *G10L 19/005* (2013.01); *G10L 19/22* (2013.01); *G10L 19/09* (2013.01); *G10L 19/10* (2013.01); *G10L 19/12* (2013.01); *G10L 25/21* (2013.01)

(58) Field of Classification Search

CPC ..... G10L 19/005
USPC ..... 704/227
See application file for complete search history.

(56) References Cited

U.S. PATENT DOCUMENTS

| | | | | |
|---|---|---|---|---|
| 5,091,945 | A * | 2/1992 | Kleijn | 704/219 |
| 5,313,635 | A | 5/1994 | Ishizuka et al. | |
| 6,131,084 | A * | 10/2000 | Hardwick | 704/230 |

(Continued)

FOREIGN PATENT DOCUMENTS

| | | | |
|---|---|---|---|
| CN | 101009536 | A | 8/2007 |
| JP | 5088907 | A | 4/1993 |

(Continued)

OTHER PUBLICATIONS

Sanneck, Henning A., and Nguyen TL Le. "Speech-property-based FEC for Internet telephony applications." Electronic Imaging. International Society for Optics and Photonics, 1999.*

(Continued)

*Primary Examiner* — Brian Albertalli
(74) *Attorney, Agent, or Firm* — Austin Rapp & Hardman

(57) ABSTRACT

A method for redundant frame coding by an electronic device is described. The method includes determining an adaptive codebook energy and a fixed codebook energy based on a frame. The method also includes coding a redundant version of the frame based on the adaptive codebook energy and the fixed codebook energy. The method further includes sending a subsequent frame.

58 Claims, 12 Drawing Sheets

(56) References Cited

U.S. PATENT DOCUMENTS

| | | | | |
|---|---|---|---|---|
| 6,687,248 | B2 | 2/2004 | Jiang | |
| 6,757,654 | B1 * | 6/2004 | Westerlund et al. | 704/262 |
| 6,785,261 | B1 * | 8/2004 | Schuster et al. | 370/352 |
| 6,922,393 | B2 | 7/2005 | Jiang et al. | |
| 7,050,397 | B2 | 5/2006 | Cheng et al. | |
| 7,558,243 | B2 | 7/2009 | Jiang | |
| 7,720,043 | B2 | 5/2010 | Meylan et al. | |
| 7,869,396 | B2 | 1/2011 | Chun et al. | |
| 7,921,347 | B2 | 4/2011 | Kim et al. | |
| 8,352,252 | B2 | 1/2013 | Fang et al. | |
| 8,422,480 | B2 | 4/2013 | Ho | |
| 9,026,434 | B2 * | 5/2015 | Greer et al. | 704/201 |
| 2002/0007473 | A1 * | 1/2002 | Heinen et al. | 714/752 |
| 2003/0005425 | A1 | 1/2003 | Zee | |
| 2005/0060143 | A1 * | 3/2005 | Ehara | 704/201 |
| 2005/0066255 | A1 | 3/2005 | Jiang | |
| 2005/0228651 | A1 | 10/2005 | Wang et al. | |
| 2005/0278169 | A1 * | 12/2005 | Hardwick | 704/223 |
| 2006/0271355 | A1 | 11/2006 | Wang et al. | |
| 2007/0177630 | A1 | 8/2007 | Ranta et al. | |
| 2007/0271094 | A1 | 11/2007 | Ashley et al. | |
| 2007/0283032 | A1 | 12/2007 | Kim et al. | |
| 2008/0043619 | A1 | 2/2008 | Sammour et al. | |
| 2008/0154587 | A1 * | 6/2008 | Gao | G10L 19/083 704/223 |
| 2009/0248404 | A1 * | 10/2009 | Ehara et al. | 704/219 |
| 2010/0063806 | A1 | 3/2010 | Gao | |
| 2010/0063811 | A1 | 3/2010 | Gao | |
| 2010/0106488 | A1 * | 4/2010 | Ehara | 704/207 |
| 2010/0286805 | A1 | 11/2010 | Gao et al. | |
| 2010/0312552 | A1 * | 12/2010 | Zheng et al. | 704/219 |
| 2011/0002266 | A1 | 1/2011 | Gao | |

FOREIGN PATENT DOCUMENTS

| | | | |
|---|---|---|---|
| JP | 2000122871 | A | 4/2000 |
| JP | 2002542662 | A | 12/2002 |
| JP | 2007053747 | A | 3/2007 |
| WO | WO-0186637 | A1 | 11/2001 |
| WO | WO-2004023736 | | 3/2004 |
| WO | WO-2006130229 | A1 | 12/2006 |
| WO | WO-2007079085 | A2 | 7/2007 |

OTHER PUBLICATIONS

Gomez, Angel M., et al. "One-pulse fec coding for robust celp-coded speech transmission over erasure channels." Multimedia, IEEE Transactions on 13.5 (2011): 894-904.*

Gómez, Angel M., et al. "A multipulse-based forward error correction technique for robust CELP-coded speech transmission over erasure channels." Audio, Speech, and Language Processing, IEEE Transactions on 18.6 (2010): 1258-1268.*

Montminy, C., and Tyseer Aboulnasr. "Improving the performance of ITU-T G. 729A for VoIP." Multimedia and Expo, 2000. ICME 2000. 2000 IEEE International Conference on. vol. 1. IEEE, 2000.*

Zhang, Jian, and Tian-Hu Yu. "A robust 6 kb/s low delay speech coder for mobile communication." Universal Personal Communications. 1995. Record., 1995 Fourth IEEE International Conference on. IEEE, 1995.*

Atungsiri, S. A., A. M. Kondoz, and B. G. Evans. "Error control for low-bit-rate speech communication systems." Communications, Speech and Vision, IEE Proceedings I. vol. 140. No. 2. IET, 1993.*

Perkis, A., and T. S. Ng. "A robust, low complexity 5.0 kbps stochastic coder for a noisy satellite channel." Computer and Communication Systems, 1990. IEEE TENCON'90., 1990 IEEE Region 10 Conference on. IEEE, 1990.*

Hermansson, H., et al. "A speech codec for cellular radio at a gross bit rate of 11.4 kb/s." Acoustics, Speech, and Signal Processing, 1991. ICASSP—91., 1991 International Conference on. IEEE, 1991.*

Tosun, Levent, and Peter Kabal. "Dynamically adding redundancy for improved error concealment in packet voice coding." Signal Processing Conference, 2005 13th European. IEEE, 2005.*

3GPP TS 36.322 v8.2.0 3rd Generation Partnership Project; Technical Specification Group Radio Access Network; Evolved Universal Terrestrial Radio Access (E-UTRA); Radio Link Control (RLC) protocol specification ((Release 8)) 3GPP TS 36.322 v8.2.0 May 2008, pp. 1-36.

Catt,"ARQ Operation",3GPP TSG-RAN WG2#57 R2-070739,Feb. 2007,URL,http://www.3gpp.org/ftp/tsg_ran/WG2_RL2/TSGR2_57/Documents/R2-070739.zip.

Huawei: "RLC Status Report Triggers", 3GPP TSG-RAN WG2 Meeting #59, R2-073169, pp. 1-3, Aug. 20-24, 2007.

International Search Report and Written Opinion—PCT/US2013/022246—ISA/EPO—Mar. 19, 2013.

Qinqing Zhang, et al.,"Performance of UMTS radio link control" Proceedings of IEEE International Conference on Communications—Apr. 28-May 2, 2002—New York, tflY, USA, IEEE, Piscataway, NJ, USA, vol. 5, Apr. 28, 2002 3346-3350, XP010590089 ISBN: 978-0-7803-7400-3 the whole document.

Qualcomm Europe: "LTE RLC Polling and Status Report Timing" 3GPP Draft; R2-074374, 3rd Generation, Partnership Project (3GPP), Mobile Competence Centre ; 650, Route Des Lucioles ; F-06921 Sophia-Antipolis Cedex ; France, vol. tsg_ran\WG2_RL2\TSGR2_59bis\Docs, no. Shanghai, China; Oct. 8, 2007, Oct. 1, 2007 XP050136944 the whole document.

R2-073476, LTE RLC PDU reordering, 3GPP TSG-RAN WG2 meeting #59, Athens, Greece, Aug. 20-24, 2007,Qualcomm Europe.

Tdoc R2-073227, RLC status reporting mechanisms, TSG-RAN WG2 Meeting 58bis, Athens, Greece, Aug. 20-24, 2007, Ericsson.

"Universal Mobile Telecommunications System (UMTS); Radio Link Control (RLC) , protocol specification (3GPP TS 25.322 version 7.2.0 Release 7); ETSI TS 125 322" ETSI Standards, LIS, Sophia Antipolis Cedex, France, vol. 3-R2, No. V7.2.0, Sep. 1, 2006, XP014035578 ISSN: 0000-0001 p. 51, paragraph 9.7.1—p. 60, paragraph 9.7.10, pp. 26-33, 34-39, 68-70, 76-78.

* cited by examiner

DEVICES FOR REDUNDANT FRAME CODING AND DECODING

RELATED APPLICATIONS

This application is related to and claims priority from U.S. Provisional Patent Application Ser. No. 61/589,103 filed Jan. 20, 2012, for "DEVICES FOR REDUNDANT FRAME CODING" and from U.S. Provisional Patent Application Ser. No. 61/661,245 filed Jun. 18, 2012, for "DEVICES FOR REDUNDANT FRAME CODING," both of which are hereby incorporated by reference.

TECHNICAL FIELD

The present disclosure relates generally to signal processing. More specifically, the present disclosure relates to devices for redundant frame coding and decoding.

BACKGROUND

In the last several decades, the use of electronic devices has become common. In particular, advances in electronic technology have reduced the cost of increasingly complex and useful electronic devices. Cost reduction and consumer demand have proliferated the use of electronic devices such that they are practically ubiquitous in modern society. As the use of electronic devices has expanded, so has the demand for new and improved features of electronic devices. More specifically, electronic devices that perform functions faster, more efficiently or with higher quality are often sought after.

Some electronic devices (e.g., cellular phones, smart phones, computers, etc.) use audio or speech signals. These electronic devices may code speech signals for storage or transmission. For example, a cellular phone captures a user's voice or speech using a microphone. The microphone converts an acoustic signal into an electronic signal. This electronic signal may then be formatted (e.g., coded) for transmission to another device (e.g., cellular phone, smart phone, computer, etc.), for playback or for storage.

Improved reliability and quality in a signal is often sought for. For example, cellular phone users may desire greater reliability and quality in a communicated speech signal. However, reliability and quality may be difficult to improve with limited resources. As can be observed from this discussion, systems and methods that may help to improve reliability and/or quality in a signal may be beneficial.

SUMMARY

A method for redundant frame coding by an electronic device is described. The method includes determining an adaptive codebook energy and a fixed codebook energy based on a frame. The method also includes coding a redundant version of the frame based on the adaptive codebook energy and the fixed codebook energy. The method further includes sending a subsequent frame. The frame may be a sub-frame. A size of the redundant version of the frame may be variable.

Coding the redundant version of the frame based on the adaptive codebook energy and the fixed codebook energy may include determining a factor based on the adaptive codebook energy and the fixed codebook energy. Coding the redundant version of the frame may include skipping coding of at least one parameter for at least one sub-frame of the frame. Coding the redundant version of the frame may include determining one or more sub-frames for skipping coding of one or more parameters on a fixed basis or on an adaptive basis.

Coding the redundant version of the frame based on the adaptive codebook energy and the fixed codebook energy may include determining whether the factor is below a first threshold, is between the first threshold and a second threshold or is above the second threshold. If the factor is below the first threshold, then coding the redundant version of the frame may include coding only one or more fixed codebook parameters for the redundant version of the frame. If the factor is between the first threshold and second threshold, then coding the redundant version of the frame may include coding one or more adaptive codebook parameters and one or more fixed codebook parameters for the redundant version of the frame.

If the factor is above the second threshold, then coding the redundant version of the frame may include coding only one or more adaptive codebook parameters for the redundant version of the frame. The factor may be M in accordance with an equation $$M = \frac{\frac{E(ACB) + E(FCB)}{E(ACB) - E(FCB)} + 1}{4}.$$

E(ACB) may be the adaptive codebook energy and E(FCB) may be the fixed codebook energy. The first threshold may be 0.15 and the second threshold may be 0.3.

Coding the redundant version of the frame may include selectively dropping one or more parameters from a primary bit-stream. Coding the redundant version of the frame may include redoing the encoding of the frame using fewer bits.

A method for redundant frame decoding by an electronic device is also described. The method includes determining whether a frame was unsuccessfully received. The method also includes determining a coding scheme by determining whether a redundant version of the frame includes only one or more adaptive codebook parameters, only one or more fixed codebook parameters, or one or more adaptive codebook parameters and one or more fixed codebook parameters if a frame was unsuccessfully received. The method further includes reconstructing the frame based on the coding scheme if a frame was unsuccessfully received.

An electronic device for redundant frame coding is also described. The electronic device includes adaptive codebook energy determination circuitry that determines an adaptive codebook energy based on a frame. The electronic device also includes fixed codebook energy determination circuitry that determines a fixed codebook energy based on the frame. The electronic device further includes a redundancy coder coupled to the adaptive codebook energy determination circuitry and to the fixed codebook energy determination circuitry. The redundancy coder codes a redundant version of the frame based on the adaptive codebook energy and the fixed codebook energy. The electronic device additionally includes transmission circuitry coupled to the redundancy coder. The transmission circuitry sends a subsequent frame.

An electronic device for redundant frame decoding is also described. The electronic device includes error detection circuitry that determines whether a frame was unsuccessfully received. The electronic device also includes coding scheme determination circuitry coupled to the error detection circuitry. The coding scheme determination circuitry determines a coding scheme by determining whether a redundant version of the frame includes only one or more adaptive codebook parameters, only one or more fixed codebook parameters, or one or more adaptive codebook parameters and one or more fixed codebook parameters if a frame was unsuccessfully received. The electronic device further includes frame reconstruction circuitry coupled to the coding scheme determination circuitry. The frame reconstruction circuitry reconstructs the frame based on the coding scheme if a frame was unsuccessfully received.

A computer-program product for redundant frame coding is also described. The computer-program product includes a non-transitory tangible computer-readable medium with instructions. The instructions include code for causing an electronic device to determine an adaptive codebook energy and a fixed codebook energy based on a frame. The instructions also include code for causing the electronic device to code a redundant version of the frame based on the adaptive codebook energy and the fixed codebook energy. The instructions additionally include code for causing the electronic device to send a subsequent frame.

A computer-program product for redundant frame decoding is also described. The computer-program product includes a non-transitory tangible computer-readable medium with instructions. The instructions include code for causing an electronic device to determine whether a frame was unsuccessfully received. The instructions also include code for causing the electronic device to determine a coding scheme by determining whether a redundant version of the frame includes only one or more adaptive codebook parameters, only one or more fixed codebook parameters, or one or more adaptive codebook parameters and one or more fixed codebook parameters if a frame was unsuccessfully received. The instructions further include code for causing the electronic device to reconstruct the frame based on the coding scheme if a frame was unsuccessfully received.

An apparatus for redundant frame coding is also described. The apparatus includes means for determining an adaptive codebook energy and a fixed codebook energy based on a frame. The apparatus also includes means for coding a redundant version of the frame based on the adaptive codebook energy and the fixed codebook energy. The apparatus further includes means for sending a subsequent frame.

An apparatus for redundant frame decoding is also described. The apparatus includes means for determining whether a frame was unsuccessfully received. The apparatus also includes means for determining a coding scheme by determining whether a redundant version of the frame includes only one or more adaptive codebook parameters, only one or more fixed codebook parameters, or one or more adaptive codebook parameters and one or more fixed codebook parameters if a frame was unsuccessfully received. The apparatus further includes means for reconstructing the frame based on the coding scheme if a frame was unsuccessfully received.

DETAILED DESCRIPTION

Figure 1:
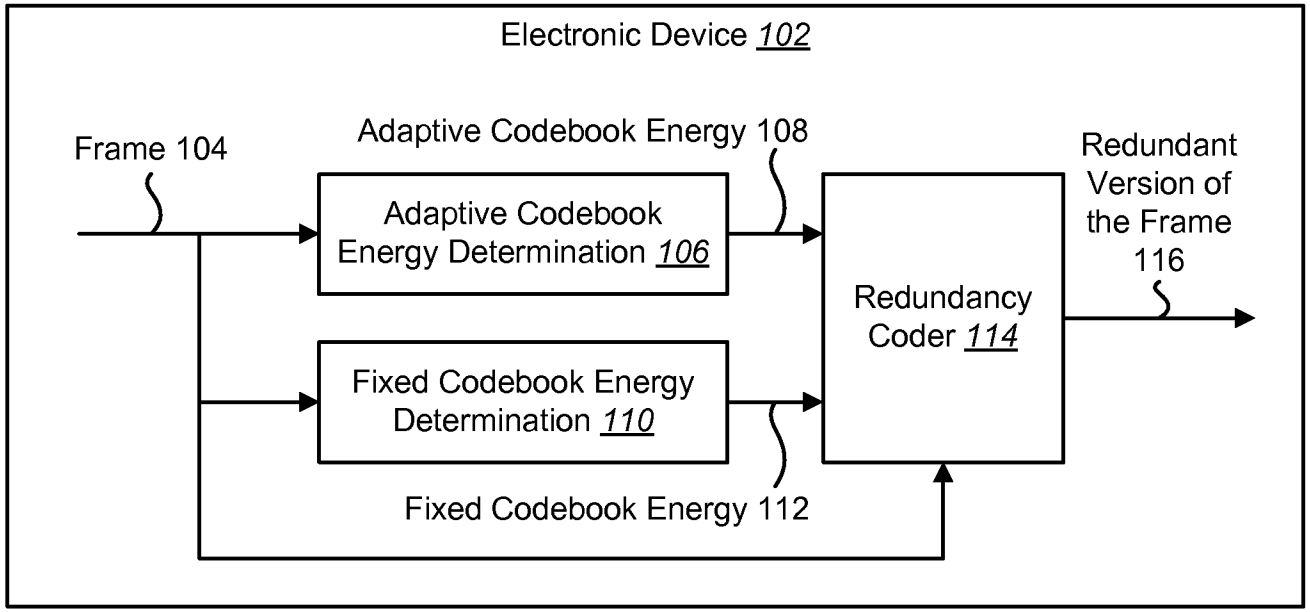
FIG. 1 is a block diagram illustrating one configuration of an electronic device in which systems and methods for redundant frame coding may be implemented.

The systems and methods disclosed herein may be applied to a variety of electronic devices. Examples of electronic devices include cellular phones, smartphones, voice recorders, video cameras, audio players (e.g., Moving Picture Experts Group-1 (MPEG-1) or MPEG-2 Audio Layer 3 (MP3) players), video players, audio recorders, desktop computers, laptop computers, personal digital assistants (PDAs), gaming systems, etc. One kind of electronic device is a communication device, which may communicate with another device. Examples of communication devices include telephones, laptop computers, desktop computers, cellular phones, smartphones, wireless or wired modems, e-readers, tablet devices, gaming systems, cellular telephone base stations or nodes, access points, wireless gateways and wireless routers, etc.

An electronic device (e.g., communication device) may operate in accordance with certain industry standards, such as International Telecommunication Union (ITU) standards and/or Institute of Electrical and Electronics Engineers (IEEE) standards (e.g., 802.11 Wireless Fidelity or "Wi-Fi" standards such as 802.11a, 802.11b, 802.11g, 802.11n, 802.11ac, etc.). Other examples of standards that a communication device may comply with include IEEE 802.16 (e.g., Worldwide Interoperability for Microwave Access or "WiMAX"), 3rd Generation Partnership Project (3GPP), 3GPP Long Term Evolution (LTE), 3rd Generation Partnership Project 2 (3GPP2), Global System for Mobile Telecommunications (GSM) and others (where a communication device may be referred to as a User Equipment (UE), NodeB, evolved NodeB (eNB), mobile device, mobile station, subscriber station, remote station, access terminal, mobile terminal, terminal, user terminal and/or subscriber unit, etc., for example). While some of the systems and methods disclosed herein may be described in terms of one or more standards, this should not limit the scope of the disclosure, as the systems and methods may be applicable to many systems and/or standards.

It should be noted that some communication devices may communicate via a wireless communication link and/or a wired communication link. For example, some communication devices may communicate with other devices via radio frequency (RF) signals, optical signals (e.g., laser link, fiber optic link), infrared (IR) signals and/or electronic signals on a wire (e.g., Ethernet cable, telephone line, etc.). The systems and methods disclosed herein may be applied to communication devices that communicate via a wireless link and/or that communicate via a wired link. In some configurations, the systems and methods disclosed herein may be applied to a communication device that communicates with another device using a satellite.

As used herein, the term "couple" and variations thereof may be used to denote a direct and/or an indirect connection. For example, a first element that is coupled to a second element may be directly connected to the second element and/or may be indirectly connected to the second element through one or more intervening elements. In some configurations, elements may be coupled via a wire, bus and/or other means for coupling.

For codecs (e.g., speech codecs) where the total number of bits transmitted every frame is a predetermined constant, transmitting a redundant copy of a past frame may require that the number of bits for coding the signal information in the current frame be reduced. This may have a perceptual quality impact on decoded speech, for example. Even for codecs that don't have the above constraint of maintaining a constant total bit-rate, it may be desirable to reduce (e.g., minimize) the number of bits used for coding the redundant version (e.g., copy) of the past frame to arrest capacity loss due to retransmissions.

The systems and methods disclosed herein provide an approach where the redundant version (e.g., copy) of a past frame may be coded using a reduced (e.g., minimal) number of bits so that the number of bits for coding the signal information in the current (e.g., primary) frame is reduced (e.g., minimal) or the impact to the capacity is reduced (e.g., minimal). For example, the systems and methods may help to reduce the number of bits for coding signal information (in one application, for instance) and/or may help to reduce capacity loss due to retransmissions (in another application, for instance). Thus, the systems and methods disclosed herein may reduce (e.g., minimize) the number of bits used for partial frame encoding while also improving (e.g., maximizing) the quality improvement via retransmission by adapting redundant frame coding schemes to be signal-dependent.

In some configurations, the systems and methods disclosed herein describe analyzing parameters from a frame encoder (e.g., primary frame encoder) to choose an appropriate coding scheme (e.g., redundancy coding scheme) for the redundant version (e.g., copy) of the previous frame. Known approaches in Code-Excited Linear Prediction (CELP) based speech codecs use an adaptive codebook (ACB) to code a pitch contribution and a fixed codebook (FCB) (in algebraic code excited linear prediction (ACELP), for example) to code an innovation contribution.

In some configurations, the energy of the adaptive codebook and the energy of the fixed codebook contributions from the primary encoded frame may be used to determine which components (e.g., speech parameters) to code in the partial frame. For example, let $$M = \frac{\frac{E(ACB) + E(FCB)}{E(ACB) - E(FCB)} + 1}{4},$$

where E(ACB) is the energy of the adaptive codebook contribution and E(FCB) is the energy of the fixed codebook contribution. If M<0.15, then a fixed codebook-only coding scheme may be selected, which may code only the fixed codebook gain and fixed codebook pulses. If 0.15<M<0.3, then a mixed (e.g., adaptive codebook and fixed codebook) coding scheme may be selected, which may code both adaptive codebook and fixed codebook speech parameters. If M>0.3, then an adaptive codebook-only coding scheme may be selected, which may code only the pitch lag and pitch gain. In some configurations, parameters (such as M, fixed codebook pulse stacking, etc.) may be analyzed at the end of encoding primary frame N to determine the partial frame coding type for frame N. However, the actual transmission of the partial (redundant) copy of frame N may occur at frame N+OFFSET (where OFFSET may be a forward error correction frame offset, for example).

The number of bits used to code some common parameters, like line spectral frequency (LSF), may also depend on the coding scheme selected. For example, if M>0.3 (which may indicate a strongly voiced frame), fewer bits (than the other cases of M<0.15 or 0.15<M<0.3) may be used to code the line spectral frequency (LSFs). This may be achieved at minimal or no loss in quality by using predictive LSF quantizers with fewer bits than the non-predictive schemes.

If M is evaluated on a sub-frame basis, then the coding scheme can also be selected on a sub-frame basis. For example, M may be evaluated for one or more sub-frames. Accordingly, a separate coding scheme may be selected for the redundant coding of each of the one or more sub-frames.

In some configurations, for the mixed mode of operation, due to a limited number of bits, not all sub-frames may be coded. For example, if the speech frame is divided into four sub-frames, then the mixed mode can be designed to skip coding of some parameters like pitch gain or pitch lag for sub-frames 2 and 4 or sub-frames 1 and 3.

Information, such as fixed codebook pulse stacking, from the primary frame can be used to further refine the partial frame coding scheme selection. For example, fixed codebook pulse stacking in the primary encoded frame may indicate that the fixed codebook is used to also code the main pitch pulse (apart from the adaptive codebook). The use of an adaptive codebook only partial coding scheme may be avoided under these conditions.

It should be noted that the systems and methods disclosed herein may be described in terms of frames for simplicity. However, the systems and methods disclosed herein may be equally applied to sub-frames. Accordingly, the term "frame" as used herein may refer to a "frame" and/or to a "sub-frame." Thus, a "frame" may be a frame (that includes one or more sub-frames, for example) or a "frame" may be a sub-frame that is included within another frame. For example, although the systems and methods disclosed herein may be described in terms of processing for a speech frame, sub-frame level processing may be similarly carried out. Thus, all of the concepts described herein may apply to a speech sub-frame as well. For instance, the factor M may be determined at a sub-frame level and one of the three described coding schemes can be selected for a particular sub-frame. Accordingly, a speech frame may have different coding schemes used for its sub-frames.

Various configurations are now described with reference to the Figures, where like reference numbers may indicate functionally similar elements. The systems and methods as generally described and illustrated in the Figures herein could be arranged and designed in a wide variety of different configurations. Thus, the following more detailed description of several configurations, as represented in the Figures, is not intended to limit scope, as claimed, but is merely representative of the systems and methods.

FIG. 1 is a block diagram illustrating one configuration of an electronic device 102 in which systems and methods for redundant frame coding may be implemented. Examples of the electronic device 102 include wireless communication devices (e.g., cellular phones, smart phones, personal digital assistants (PDAs), laptop computers, e-readers, etc.), desktop computers, telephones, audio recorders, game consoles, televisions and other devices. The electronic device 102 includes an adaptive codebook energy determination block/module 106, a fixed codebook energy determination block/module 110 and a redundancy coder 114. As used herein, a "block/module" may be implemented in hardware (e.g., circuitry), software or a combination of both. Furthermore, one or more of the elements included within the electronic device 102 may be implemented in hardware (e.g., circuitry), software or a combination of both. For example, the redundancy coder 114 may be implemented in hardware, software or a combination of both. In some configurations, the adaptive codebook energy determination block/module 106, the fixed codebook determination block/module 110 and/or the redundancy coder 114 may be included within an audio coder, which may be used to encode an audio signal and output a coded audio signal in accordance with the systems and methods disclosed herein.

The electronic device 102 may obtain a frame 104. The frame 104 may be a structure including audio signal information. For example, a frame 104 may include and/or represent one or more portions and/or components of an audio signal. For instance, a frame 104 may include an audio signal segment and/or one or more parameters and/or signals representing an audio signal segment (e.g., fixed codebook contribution, fixed codebook index, fixed codebook gain, adaptive codebook contribution, pitch lag, pitch gain, etc.). Additionally or alternatively, the content of a frame 104 may change depending on a stage of processing. In some configurations, the frame 104 may be based on an audio (e.g., speech) signal captured by one or more microphones on the electronic device 102. Additionally or alternatively, the frame 104 may be based on a received signal (e.g., an audio signal captured by another device, such as a Bluetooth headset). As described above, the frame 104 may refer to both a frame and a sub-frame. For example, the frame 104 may be a frame (including one or more sub-frames, for example) in some configurations or the frame 104 may be a sub-frame in some configurations.

The adaptive codebook energy determination block/module 106 may determine an adaptive codebook energy 108 based on the frame 104. For example, the adaptive codebook energy determination block/module 106 may determine the adaptive codebook energy 108 based on an adaptive codebook contribution of the frame 104. In some configurations, the adaptive codebook energy 108 may be determined in accordance with the equation $E(ACB(n))=\Sigma ACB^2(n)$, where $E(ACB(n))$ is the adaptive codebook energy 108, $ACB(n)$ is the adaptive codebook contribution, $n=0, \ldots, N-1$ and N is the length (in samples) of the adaptive codebook contribution.

The fixed codebook energy determination block/module 110 may determine a fixed codebook energy 112 based on the frame 104. For example, the fixed codebook energy determination block/module 110 may determine the fixed codebook energy 112 of a fixed codebook contribution of the frame 104. In some configurations, the fixed codebook energy 112 may be determined in accordance with the equation $E(FCB(n))=\Sigma FCB^2(n)$, where $E(FCB(n))$ is the fixed codebook energy 112, $FCB(n)$ is the fixed codebook contribution, $n=0, \ldots, N-1$ and N is the length (in samples) of the fixed codebook contribution.

The redundancy coder 114 may be coupled to the adaptive codebook energy determination block/module 106 and to the fixed codebook determination block/module 110. The redundancy coder 114 may code (e.g., generate) a redundant version of the frame 116 based on the adaptive codebook energy 108 and the fixed codebook energy 112. For example, the redundancy coder 114 may code the frame 104 into a redundant version of the frame 116 based on the adaptive codebook energy 108 and the fixed codebook energy 112. The redundant version of the frame 116 may be inserted into (e.g., piggybacked with) a subsequent frame. The subsequent frame may or may not immediately follow the frame 104. For example, the subsequent frame may be the next frame after the first frame. Alternatively, one or more other frames (or sub-frames) may occur between the first frame and the subsequent frame.

In the case where the frame 104 is a sub-frame, the redundant version of the frame 116 may contain redundant information corresponding to the sub-frame. In this case, the redundant version of the (sub-) frame 116 may be inserted into a subsequent full frame and/or sub-frame. In some configurations and/or cases, the electronic device 102 (e.g., redundancy coder 114) may perform redundancy coding separately for multiple sub-frames. The redundant version of each sub-frame may be inserted into the subsequent frame and sent.

It should be noted that coding a redundant version of the frame 116 or redundant frame coding may include full and/or partial redundancy coding schemes. For example, the redundancy coder 114 may code or generate a partial redundant bit-stream. In one partial redundancy coding approach, the redundancy coder 114 may selectively drop one or more parameters from the primary bit-stream (corresponding to the frame 104, for example) to create a subset of the primary bit-stream. For instance, the redundant version of the frame 116 may contain a subset of the bits included in the fully coded frame (corresponding to the frame 104). In another partial redundancy coding approach, the redundancy coder 114 may redo the encoding of the frame 104 (e.g., primary frame) using fewer bits. In this approach, the redundant version of the frame 116 (e.g., a partial bit-stream) may be completely different from the fully coded frame (e.g., the primary bit-stream corresponding to the frame 104).

The electronic device 102 may include a transmission block/module (not shown in FIG. 1) that is coupled to the redundancy coder 114. The transmission block/module may send the subsequent frame (including the redundant version of the frame 116, for example).

In some configurations, the electronic device 102 may transmit the frame 104 (e.g., part of a coded audio signal) to another device. If the frame 104 is unsuccessfully received (e.g., not received or received with errors) by the other device, the other device may reconstruct the frame based on the redundant version of the frame 116. For example, the other device may reconstruct the frame based on the redundant version of the frame 116 received with the subsequent frame. This approach may reduce capacity lost due to retransmissions. Additionally or alternatively, the redundant version of the frame 116 may beneficially increase the likelihood of successful decoding by the other device. It should be noted that the functions described based on the frame 104 may additionally or alternatively be performed on a sub-frame basis.

Figure 2:
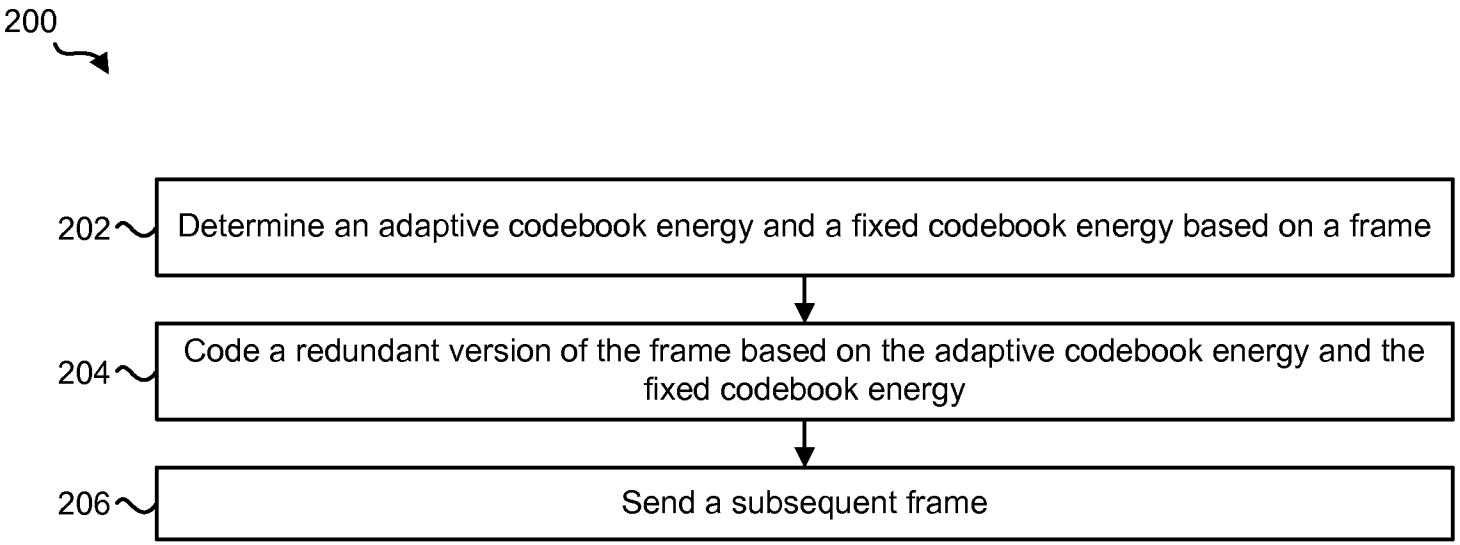
FIG. 2 is a flow diagram illustrating one configuration of a method for redundant frame coding.

FIG. 2 is a flow diagram illustrating one configuration of a method 200 for redundant frame coding. An electronic device 102 may determine 202 an adaptive codebook energy 108 and a fixed codebook energy 112 based on a frame 104. For example, the electronic device 102 may determine 202 the energy of the adaptive codebook contribution and the energy of the fixed codebook contribution of the frame 104.

It should be noted that the electronic device 102 may code the frame 104 to produce a coded frame. For example, the electronic device 102 may code the frame 104 (with a primary coder, for example) in order to determine one or more parameters and/or signals based on the frame 104. The electronic device 102 may accordingly determine 202 the adaptive codebook energy 108 and the fixed codebook energy 112 based on the one or more parameters and/or signals from the frame 104 coding. The coded frame may be sent (via wired and/or wireless transmission, for example).

The electronic device 102 may code 204 a redundant version of the frame 116 based on the adaptive codebook energy 108 and the fixed codebook energy 112. For example, coding 204 the redundant version of the frame 116 may include determining which components of the frame 104 to code into the redundant version of the frame 116. For instance, the electronic device 102 may determine whether to code only fixed codebook parameters (e.g., fixed codebook gain and/or fixed codebook pulses), only adaptive codebook parameters (e.g., pitch lag and/or pitch gain) or both into the redundant version of the frame 116 based on the adaptive codebook energy 108 and the fixed codebook energy 112. In one example, a fixed codebook coding scheme may include coding only fixed codebook parameters, an adaptive codebook coding scheme may include coding only adaptive codebook parameters and a mixed coding scheme may include coding one or more parameters from both. Examples of adaptive codebook parameters include pitch lag and pitch gain. Examples of fixed codebook parameters include fixed codebook pulses and fixed codebook gain.

In some configurations, coding 204 the redundant version of the frame 116 includes determining a factor. The factor may be based on the adaptive codebook energy 108 and the fixed codebook energy 112. For example, the factor may be a ratio of the adaptive codebook energy and the fixed codebook energy. In some configurations, the electronic device 102 may determine which parameters to code based on the factor and one or more thresholds. For example, the electronic device 102 may determine whether the factor is below (e.g., less than (<) or less than or equal to (≤)) a first threshold, is between the first threshold and a second threshold (e.g., greater than (>) or greater than or equal to (≥) the first threshold and less than (<) or less than or equal to (≤) the second threshold) or is above (e.g., greater than (>) or greater than or equal to (≥)) the second threshold. The electronic device 102 may code certain parameters into the redundant version of the frame 116 based on the range that includes the factor.

In one example, the electronic device 102 may determine a factor $$M = \frac{\frac{E(ACB) + E(FCB)}{E(ACB) - E(FCB)} + 1}{4},$$

where E(ACB) is the adaptive codebook energy 108 and E(FCB) is the fixed codebook energy 112. The electronic device 102 may determine whether M is less than a first threshold (e.g., M<0.15), whether M is between the first threshold and the second threshold (e.g., 0.15<M<0.3) or whether M is greater than the second threshold (e.g., M>0.3). If M is less than the first threshold, then a fixed codebook-only coding scheme may be selected to code 204 the redundant version of the frame 116, where only fixed codebook gain and fixed codebook pulses are coded. If M is between the first and second thresholds (e.g., 0.15<M<0.3), then a mixed coding scheme may be selected to code 204 the redundant version of the frame 116, where both adaptive codebook and fixed codebook speech parameters are coded. If M is greater than the second threshold, then an adaptive codebook-only coding scheme may be selected to code 204 the redundant version of the frame 116, where only pitch lag and pitch gain may be coded.

In some configurations, the electronic device 102 may skip coding of at least one parameter for at least one sub-frame of the frame 104. For example, in the case where adaptive codebook and fixed codebook speech parameters are coded (e.g., in a mixed coding mode) not all sub-frames may be coded in some cases due to a limited number of bits. For example, if the speech frame is divided into 4 sub-frames, then the mixed mode can be designed to skip coding of some parameters like pitch gain, pitch lag, fixed codebook pulses and/or fixed codebook gain for sub-frames 2 and 4 or sub-frames 1 and 3. The decision on which sub-frames to code may be fixed or may be adaptively determined. Zero bit sub-frames may be synthesized by extrapolating the previous sub-frame. For example, the electronic device 102 may compare a zero bit synthesized sub-frame to its coded version or to the original audio signal to determine if extrapolation from the previous sub-frame is sufficient or not.

In some configurations, the size of the redundant version of the frame 116 may be variable. For example, the size of the redundant version of the frame 116 may be variable based on the subsequent frame. More specifically, the electronic device 102 may determine a number of bits allocated to the redundant version of the frame 116 based on the subsequent frame (e.g., size of the subsequent frame and/or amount of data included in the subsequent frame).

It should be noted that coding 204 a redundant version of the frame 116 or redundant frame coding may include full and/or partial redundancy coding schemes. In one partial redundancy coding approach, the electronic device 102 may selectively drop one or more parameters from the primary bit-stream (corresponding to the frame 104, for example) to create a subset of the primary bit-stream. For instance, the redundant version of the frame 116 may contain a subset of the bits included in the fully coded frame (corresponding to the frame 104). In another partial redundancy coding approach, the electronic device 102 may redo the encoding of the frame 104 (e.g., primary frame) using fewer bits. In this approach, the redundant version of the frame 116 (e.g., a partial bit-stream) may be completely different from the fully coded frame (e.g., the primary bit-stream corresponding to the frame 104).

The electronic device 102 may send 206 a subsequent frame. In some configurations, for example, the electronic device 102 may send 206 the subsequent frame using wired and/or wireless transmission. Additionally or alternatively, the subsequent frame may be sent 206 to memory for storage. The redundant version of the frame 116 may be sent 206 with (e.g., piggybacked with) the subsequent frame. For example, the electronic device 102 may insert the redundant version of the frame 116 into the subsequent frame. The subsequent frame may or may not immediately follow the frame 104.

It should be noted that the electronic device 102 may perform one or more of the functions or procedures in the method 200 on a sub-frame basis. For example, the electronic device 102 may determine 202 an adaptive codebook energy 108 and a fixed codebook energy 112 based on a (sub-) frame 104. Additionally or alternatively, the electronic device 102 may code 204 a redundant version of the (sub-) frame 116 based on the adaptive codebook energy 108 and the fixed codebook energy 112.

Figure 3:
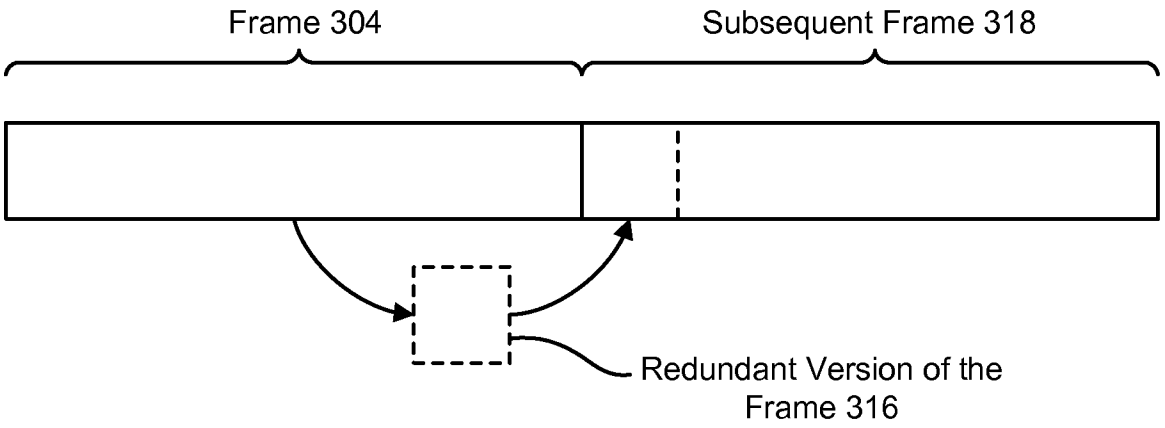
FIG. 3 is a diagram illustrating one example of a redundant version of a frame in accordance with the systems and methods disclosed herein.

FIG. 3 is a diagram illustrating one example of a redundant version of a frame 316 in accordance with the systems and methods disclosed herein. In particular, FIG. 3 illustrates a frame 304, a redundant version of the frame 316 and a subsequent frame 318. As described above, the electronic device 102 may determine an adaptive codebook energy 108 and a fixed codebook energy 112 based on the frame 304. For example, the electronic device 102 may code the frame 304 in order to determine the adaptive codebook energy 108 and the fixed codebook energy 112.

The electronic device 102 may code the redundant version of the frame 316 based on the adaptive codebook energy 108 and the fixed codebook energy 112. For example, the electronic device 102 may code only adaptive codebook parameters, only fixed codebook parameters or both in the redundant version of the frame 316 based on the adaptive codebook energy 108 and the fixed codebook energy 112. For instance, the electronic device 102 may select a coding scheme for the redundant version of the frame 316 based on the adaptive codebook energy 108 and the fixed codebook energy 112.

The electronic device 102 may insert the redundant version of the frame 316 into the subsequent frame 318. The subsequent frame 318 may immediately follow the frame 304. Alternatively, the subsequent frame 318 may not immediately follow the frame 304 (e.g., there may be one or more other frames in between the frame 304 and the subsequent frame 318).

Figure 4:
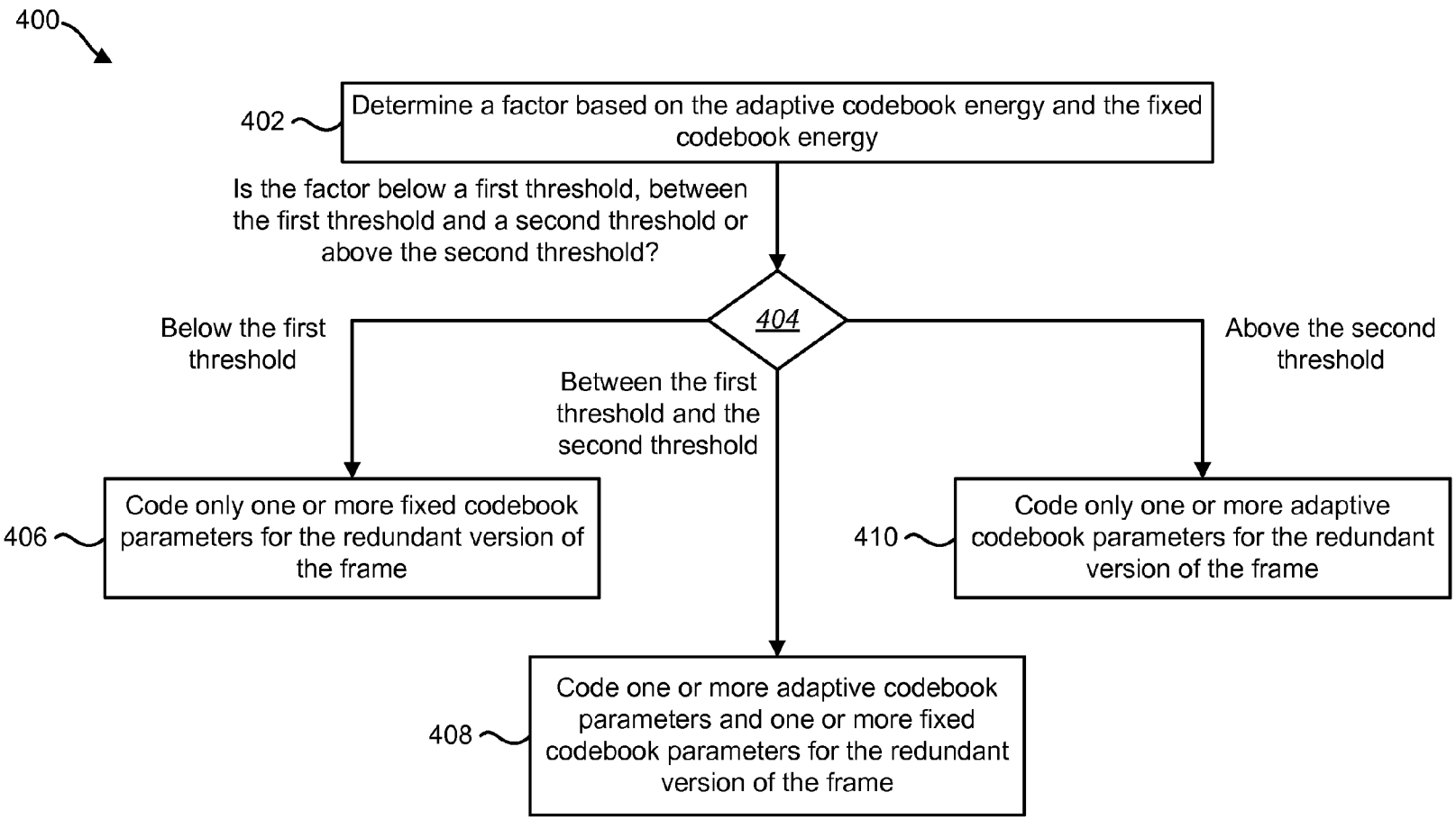
FIG. 4 is a flow diagram illustrating one configuration of a method for coding a redundant version of a frame.

FIG. 4 is a flow diagram illustrating one configuration of a method 400 for coding a redundant version of a frame 116. The electronic device 102 may determine 402 a factor based on the adaptive codebook energy 108 and the fixed codebook energy 112. For example, the factor may be a ratio of the adaptive codebook energy 108 and the fixed codebook energy 112. For instance, the factor may be $$M = \frac{\frac{E(ACB) + E(FCB)}{E(ACB) - E(FCB)} + 1}{4},$$

as described above.

The electronic device 102 may determine 404 whether the factor is below a first threshold, between the first threshold and a second threshold or above the second threshold. For example, the electronic device 102 may determine whether the factor is below (e.g., less than (<) or less than or equal to (≤)) the first threshold, is between the first threshold and a second threshold (e.g., greater than (>) or greater than or equal to (≥) the first threshold and less than (<) or less than or equal to (≤) the second threshold) or is above (e.g., greater than (>) or greater than or equal to (≥)) the second threshold. In some configurations, the first threshold may be 0.15 and the second threshold may be 0.3. It should be noted that other thresholds may be used.

If the factor is below the first threshold, the electronic device 102 may code 406 only one or more fixed codebook parameters for the redundant version of the frame 116. For example, the electronic device 102 may code 406 only fixed codebook gain and fixed codebook pulses for the redundant version of the frame 116.

If the factor is between the first threshold and the second threshold, the electronic device 102 may code 408 one or more adaptive codebook parameters and one or more fixed codebook parameters for the redundant version of the frame 116. For example, the electronic device 102 may code 408 one or more of fixed codebook gain and fixed codebook pulses and one or more of pitch lag and pitch gain for the redundant version of the frame 116.

If the factor is above the second threshold, the electronic device 102 may code 410 only one or more adaptive codebook parameters for the redundant version of the frame 116. For example, the electronic device 102 may code 410 only pitch lag and pitch gain for the redundant version of the frame 116. It should be noted that the electronic device 102 may perform one or more of the functions or procedures in the method 400 on a sub-frame basis.

Figure 5:
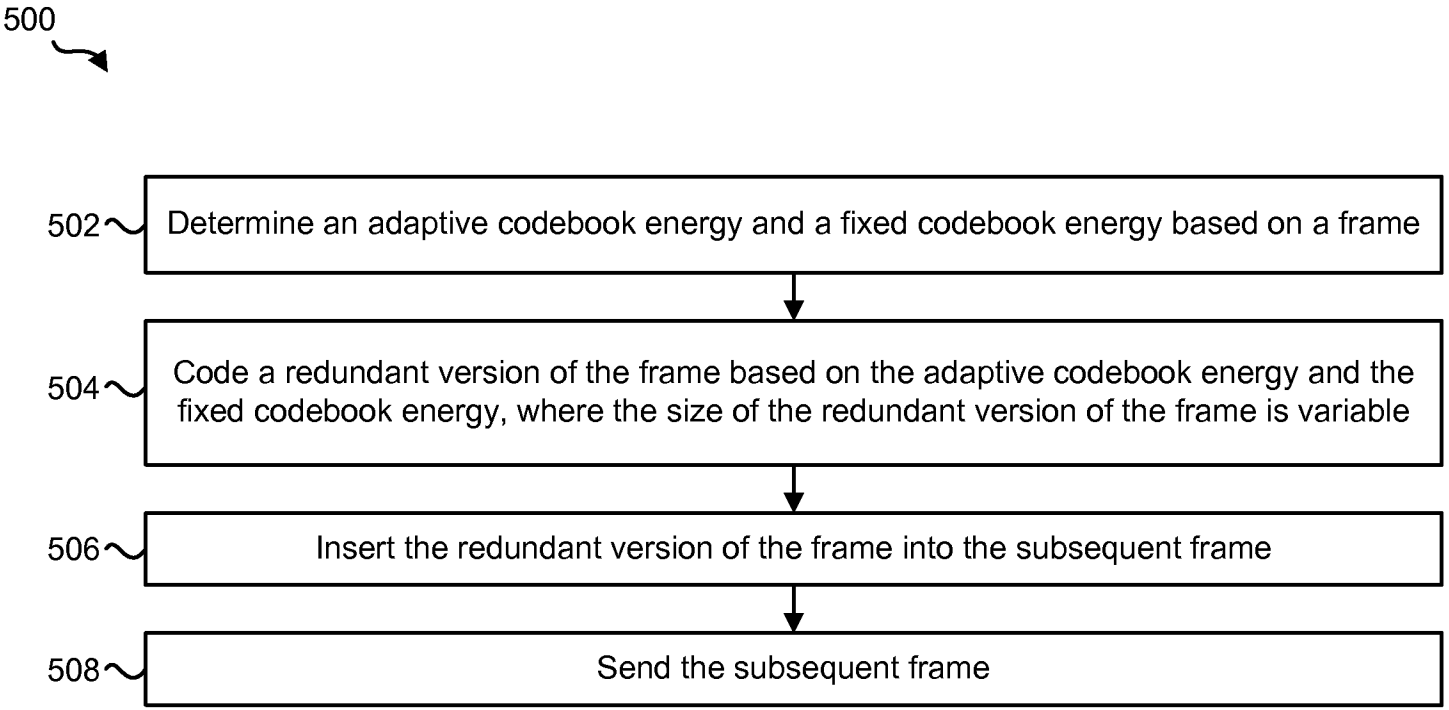
FIG. 5 is a flow diagram illustrating a more specific configuration of a method for redundant frame coding.

FIG. 5 is a flow diagram illustrating a more specific configuration of a method 500 for redundant frame coding. An electronic device 102 may determine 502 an adaptive codebook energy 108 and a fixed codebook energy 112 based on a frame 104. This may be done as described above in connection with FIG. 2, for example. For instance, the electronic device 102 may determine 502 the energy of the adaptive codebook contribution and the energy of the fixed codebook contribution of the frame 104.

The electronic device 102 may code 504 a redundant version of the frame 116 based on the adaptive codebook energy 108 and the fixed codebook energy 112, where the size of the redundant version of the frame 116 is variable. For example, coding 504 the redundant version of the frame 116 may proceed as described above in connection with FIG. 2. However, the size of the redundant version of the frame 116 may vary based on one or more factors.

In some configurations, the size of the redundant version of the frame 116 may be based on a subsequent frame (e.g., the size of the redundant version may be variable based on the subsequent frame). In some examples, the frame 104 may be coded (and sent, for instance) and the frame 104, a copy of the frame 104 and/or one or more parameters based on the frame 104 may be stored in memory. Alternatively, frame 104 coding may be delayed until a subsequent frame. The subsequent frame may also be coded in order to determine a rate or a number of bits for the primary coding of the subsequent frame. The electronic device 102 may then determine a size (e.g., a number of bits) to allocate for the redundant version of the frame 116. For example, the electronic device 102 may determine how far a peak rate for the subsequent frame can be reduced. Accordingly, the electronic device 102 may code 504 the redundant version of the frame 116 based on the adaptive codebook energy 108 and the fixed codebook energy 112 while taking into account a size allocated for the redundant version of the frame 116. In some configurations, the size of the redundant version of the frame 116 is dependent on the size of the primary frame. The peak rate reduction scheme can have different configurations depending on how bad the channel is. For example, under bad channel conditions, the peak rate reducer can be made more aggressive to free up more bits to enable transmitting a larger size redundant version of the frame 116 (for better quality at reconstruction) as compared to a scenario where the channel quality is not as bad. The frequency of transmitting a redundant version of the frame 116 may also be a function of the channel quality.

The electronic device 102 may insert 506 the redundant version of the frame 116 into the subsequent frame. The electronic device 102 may send 508 the subsequent frame. In some configurations, for example, the electronic device 102 may send 508 the subsequent frame using wired and/or wireless transmission. Additionally or alternatively, the subsequent frame may be sent 508 to memory for storage. The subsequent frame may or may not immediately follow the frame 104. It should be noted that the electronic device 102 may perform one or more of the functions or procedures in the method 500 on a sub-frame basis.

Figure 6:
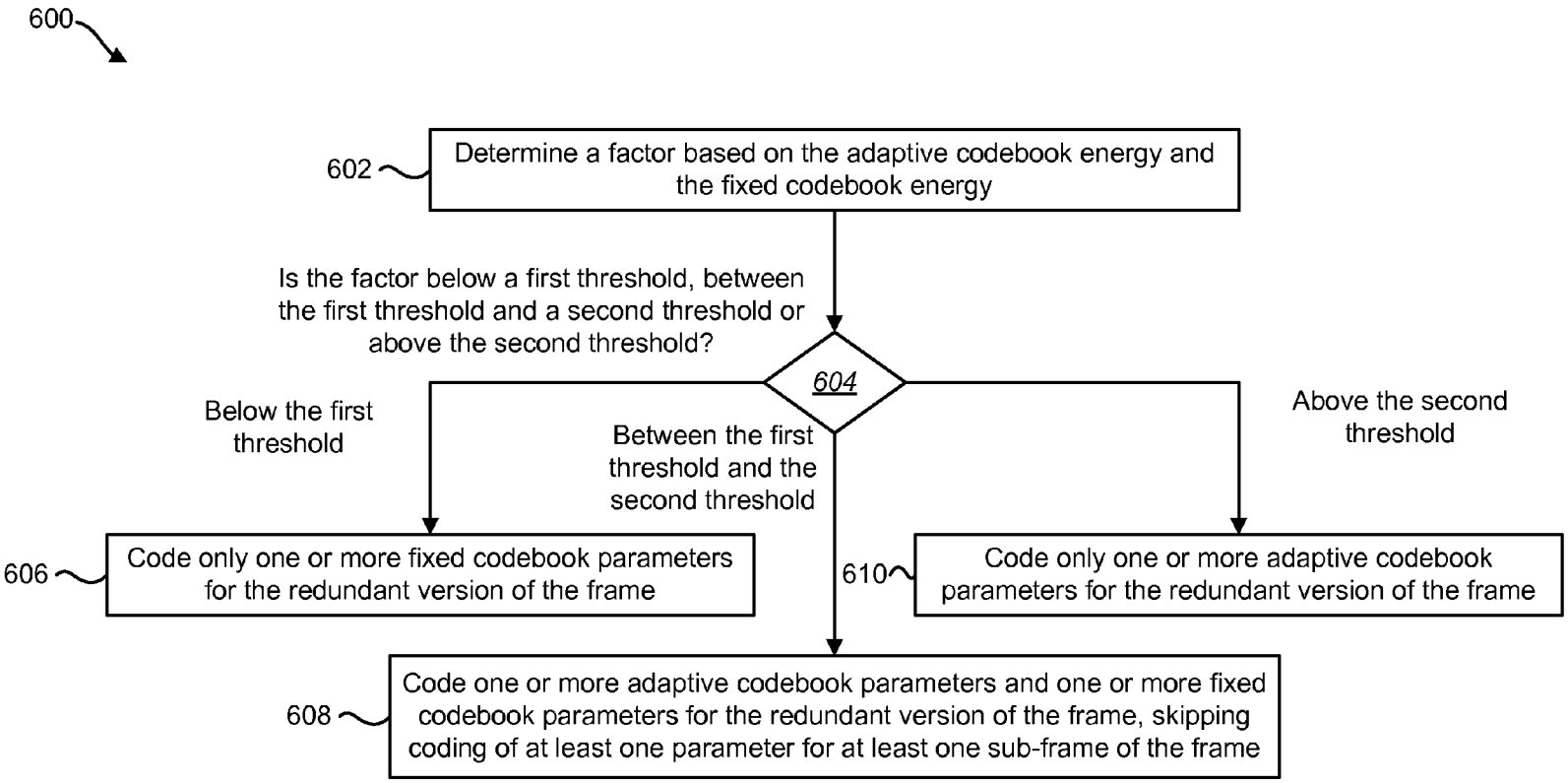
FIG. 6 is a flow diagram illustrating a more specific configuration of a method for coding a redundant version of a frame.

FIG. 6 is a flow diagram illustrating a more specific configuration of a method 600 for coding a redundant version of a frame 116. The electronic device 102 may determine 602 a factor based on the adaptive codebook energy 108 and the fixed codebook energy 112. For example, the factor may be a ratio of the adaptive codebook energy 108 and the fixed codebook energy 112. For instance, the factor may be $$M = \frac{\frac{E(ACB) + E(FCB)}{E(ACB) - E(FCB)} + 1}{4},$$

as described above.

The electronic device 102 may determine 604 whether the factor is below a first threshold, between the first threshold and a second threshold or above the second threshold. For example, the electronic device 102 may determine whether the factor is below (e.g., less than (<) or less than or equal to (≤)) the first threshold, is between the first threshold and a second threshold (e.g., greater than (>) or greater than or equal to (≥) the first threshold and less than (<) or less than or equal to (≤) the second threshold) or is above (e.g., greater than (>) or greater than or equal to (≥)) the second threshold. In some configurations, the first threshold may be 0.15 and the second threshold may be 0.3. It should be noted that other thresholds may be used.

If the factor is below the first threshold, the electronic device 102 may code 606 only one or more fixed codebook parameters for the redundant version of the frame 116. For example, the electronic device 102 may code 606 only fixed codebook gain and fixed codebook pulses for the redundant version of the frame 116.

If the factor is between the first threshold and the second threshold, the electronic device 102 may code 608 one or more adaptive codebook parameters and one or more fixed codebook parameters for the redundant version of the frame 116, skipping coding of at least one parameter for at least one sub-frame of the frame 104. For example, the electronic device 102 may code 608 one or more of fixed codebook gain and fixed codebook pulses and one or more of pitch lag and pitch gain for the redundant version of the frame 116, where one or more parameters is omitted for one or more sub-frames. In particular, in the case where adaptive codebook parameter(s) and fixed codebook parameter(s) are coded (e.g., in a mixed coding scheme), not all sub-frames may be coded. This may be due to a limited number of bits. For example, if the frame 104 is divided into 4 sub-frames, then the mixed coding scheme may skip coding of some parameters like pitch gain, pitch lag, fixed codebook pulses and/or fixed codebook gain for one or more sub-frames. For example, one or more parameters may not be coded for sub-frames 2 and 4 or sub-frames 1 and 3.

The electronic device 102 may determine one or more sub-frames for coding (or skipping coding of) one or more parameters on a fixed basis or on an adaptive basis. For example, the electronic device 102 may determine to skip coding of one or more parameters for one or more sub-frames on a fixed basis. For instance, one or more parameters may be coded (or skipped) in one or more fixed sub-frames (e.g., sub-frames 1 and 3 or 2 and 4). In another example, the electronic device 102 may adaptively determine one or more sub-frames for coding (or skipping coding of) one or more parameters. For instance, skipped (e.g., zero-bit) sub-frames may be synthesized by extrapolating the previous sub-frame. For example, the electronic device 102 may compare a skipped (e.g., zero-bit) synthesized sub-frame to its coded version or to the original audio signal to determine if extrapolation from the previous sub-frame is sufficient (e.g., meets one or more criteria) or not. If it is not sufficient, the electronic device 102 may code one or more parameters for that sub-frame instead of skipping it. However, if it is sufficient, the electronic device 102 may skip coding parameters for that sub-frame. Accordingly, the electronic device 102 may determine to skip coding for one or more entire sub-frames (e.g., of all parameters of one or more sub-frames) on a fixed basis or an adaptive basis in some cases and/or configurations. In other cases and/or configurations, the electronic device 102 may only determine to skip coding of one or more but not all parameters for one or more sub-frames on a fixed basis or an adaptive basis.

If the factor is above the second threshold, the electronic device 102 may code 610 only one or more adaptive codebook parameters for the redundant version of the frame 116. For example, the electronic device 102 may code 610 only pitch lag and pitch gain for the redundant version of the frame 116. It should be noted that the electronic device 102 may perform one or more of the functions or procedures in the method 600 on a sub-frame basis.

Figure 7:
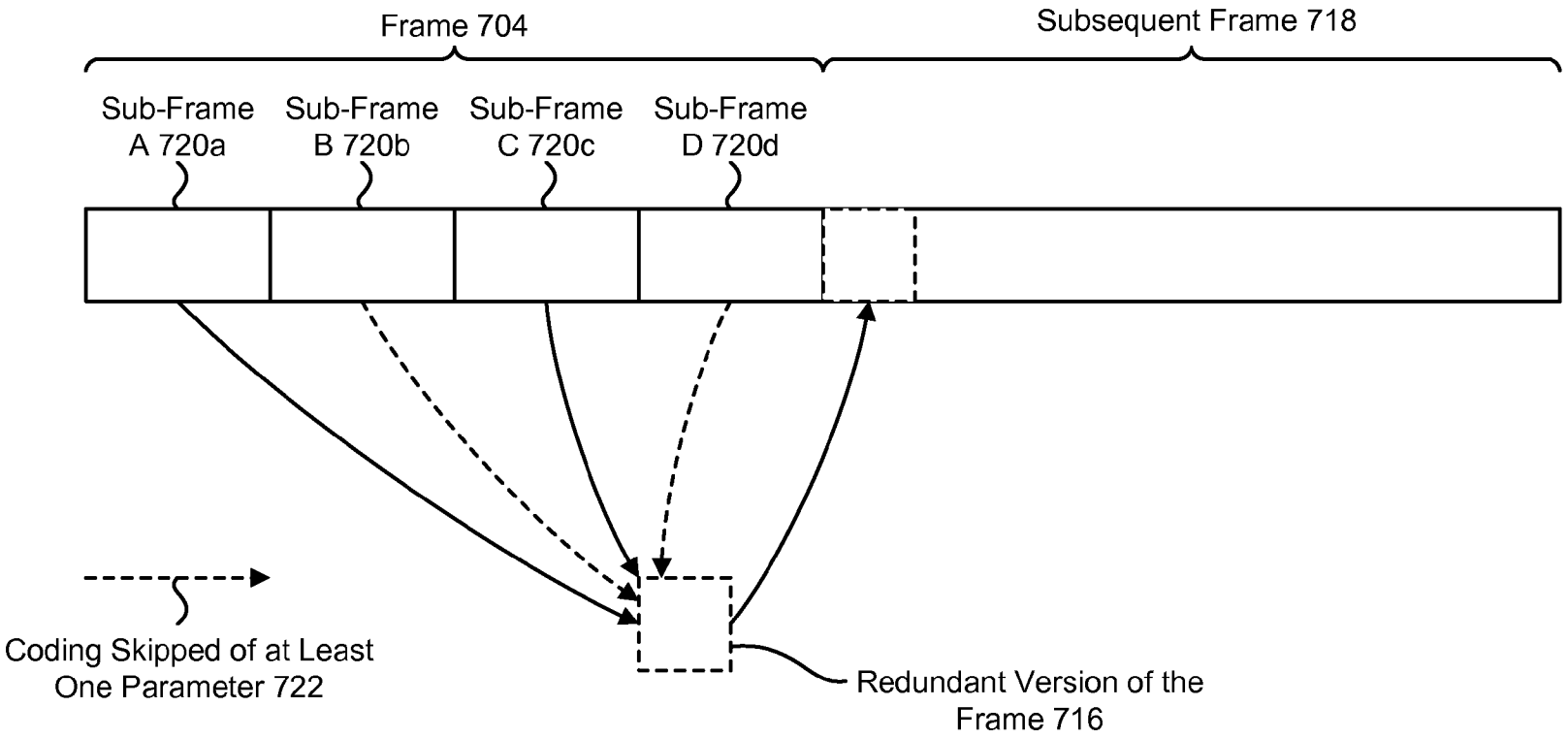
FIG. 7 is a diagram illustrating a more specific example of a redundant version of a frame in accordance with the systems and methods disclosed herein.

FIG. 7 is a diagram illustrating a more specific example of a redundant version of a frame 716 in accordance with the systems and methods disclosed herein. In particular, FIG. 7 illustrates a frame 704, sub-frames A-D 720*a-d*, a redundant version of the frame 716 and a subsequent frame 718. As described above, the electronic device 102 may determine an adaptive codebook energy 108 and a fixed codebook energy 112 based on the frame 704. For example, the electronic device 102 may code the frame 704 in order to determine the adaptive codebook energy 108 and the fixed codebook energy 112.

As similarly described above, the electronic device 102 may skip coding of one or more parameters for the redundant version of the frame 716 in some cases and/or configurations. The example illustrated in FIG. 7 shows coding skipped of at least one parameter 722 for sub-frame B 720*b* and sub-frame D 720*d*. In some configurations, the electronic device 102 may skip coding of at least one parameter 722 for at least one sub-frame 720 for a mixed coding scheme. For instance, the electronic device 102 may code one or more adaptive codebook parameters (e.g., pitch lag, pitch gain) and one or more fixed codebook parameters (e.g., fixed codebook pulses, fixed codebook gain) for sub-frame A 720*a* and sub-frame C 720*c* while skipping coding of at least one parameter 722 for sub-frame B 720*b* and sub-frame D 720*d* for the redundant version of the frame 716.

More generally, one or more adaptive codebook parameters and one or more fixed codebook parameters may be coded for one or more sub-frames while coding of one or more parameters may be skipped for one or more sub-frames for the redundant version of the frame. It should be noted that the redundant coding of a frame may be different than the primary coding of a frame.

In some configurations, the electronic device 102 may determine one or more sub-frames for which one or more parameters may be coded (or skipped). This may be done on a fixed basis or an adaptive basis. For example, sub-frame B 720*b* and sub-frame D 720*d* may be fixed as sub-frames where coding of at least one parameter is skipped 722. In an adaptive approach, the electronic device 102 may determine whether extrapolating from sub-frame A 720*a* is sufficient to reconstruct (to a particular degree of accuracy, for example) sub-frame B 720*b* if no parameters are coded for sub-frame B 720*b* (e.g., if sub-frame B 720*b* is a zero-bit frame). This may be done, for example, by comparing a zero-bit synthesized version of sub-frame B 720*b* to a coded version of sub-frame B 720*b* or to an original audio signal segment corresponding to sub-frame B 720*b*. If it is sufficient, then the electronic device 102 may skip coding of parameter(s) 722 for sub-frame B 720*b* for the redundant version of the frame 716, as illustrated in FIG. 7. Otherwise, one or more parameters of sub-frame B 720*b* may be coded for the redundant version of the frame 716. A similar procedure may be followed for one or more other sub-frames (e.g., for sub-frame C 720*c* and sub-frame D 720*d*).

The electronic device 102 may insert the redundant version of the frame 716 into the subsequent frame 718. The subsequent frame 718 may immediately follow the frame 704. Alternatively, the subsequent frame 718 may not immediately follow the frame 704 (e.g., there may be one or more other frames in between the frame 704 and the subsequent frame 718).

Figure 8:
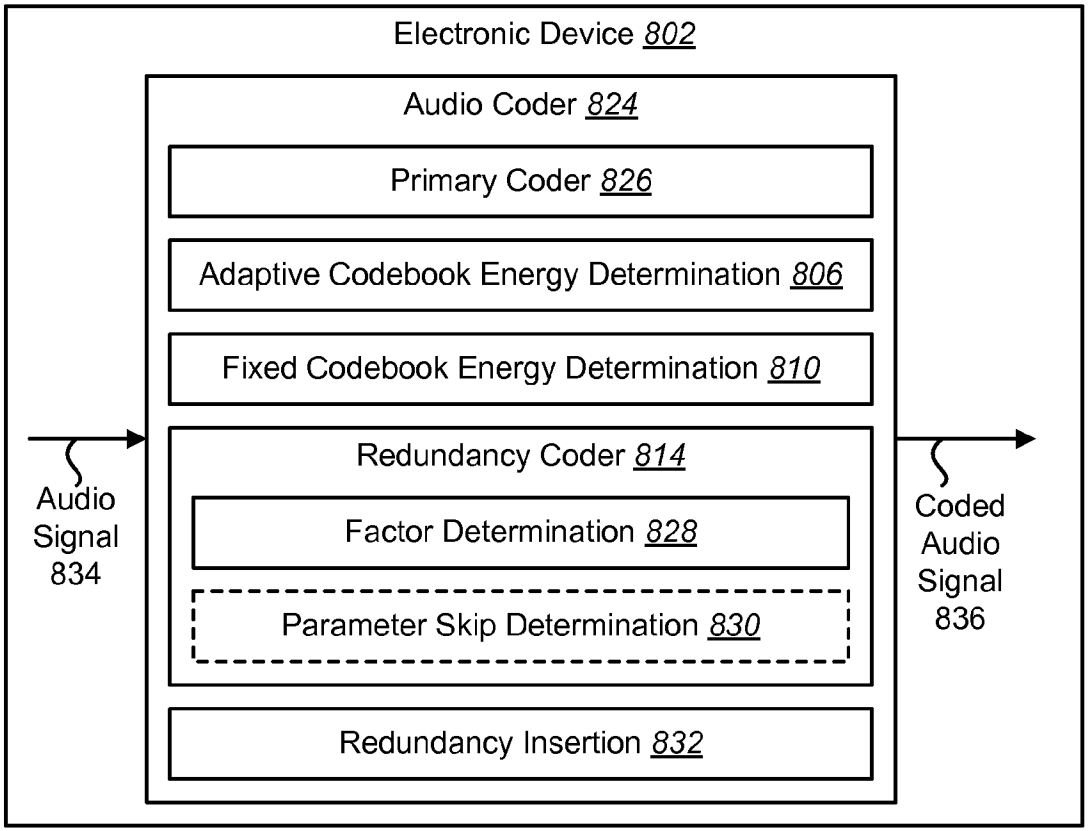
FIG. 8 is a block diagram illustrating a more specific configuration of an electronic device in which systems and methods for redundant frame coding may be implemented.

FIG. 8 is a block diagram illustrating a more specific configuration of an electronic device 802 in which systems and methods for redundant frame coding may be implemented. Examples of the electronic device 802 include wireless communication devices (e.g., cellular phones, smart phones, personal digital assistants (PDAs), laptop computers, e-readers, etc.), desktop computers, telephones, audio recorders, game consoles, televisions and other devices. The electronic device 802 includes an audio coder 824. The audio coder 824 may code an audio signal 834 to produce a coded audio signal 836 in accordance with the systems and methods disclosed herein. For example, the coded audio signal 836 may include one or more coded frames that may be sent to another device and/or to memory for storage.

The audio coder 824 may include a primary coder 826, an adaptive codebook energy determination block/module 806, a fixed codebook energy determination block/module 810, a redundancy coder 814 and/or a redundancy insertion block/module 832. As used herein, a "block/module" may be implemented in hardware (e.g., circuitry), software or a combination of both. Furthermore, one or more of the elements included within the electronic device 802 may be implemented in hardware (e.g., circuitry), software or a combination of both. For example, the redundancy coder 814 may be implemented in hardware, software or a combination of both.

The electronic device 802 may obtain a frame based on the audio signal 834. In some configurations, the primary coder 826 may code a portion of the audio signal 834 to obtain the frame. The frame may be a structure including audio signal information. For example, a frame may include and/or represent one or more portions and/or components of the audio signal 834. For instance, a frame may include an audio signal segment and/or one or more parameters and/or signals representing an audio signal segment (e.g., fixed codebook contribution, fixed codebook index, fixed codebook gain, adaptive codebook contribution, pitch lag, pitch gain, etc.). Additionally or alternatively, the content of a frame may change depending on a stage of processing. In some configurations, the frame may be based on an audio signal 834 (e.g., speech signal) captured by one or more microphones on the electronic device 802. Additionally or alternatively, the frame may be based on a received signal (e.g., an audio signal captured by another device, such as a Bluetooth headset).

The adaptive codebook energy determination block/module 806 may determine an adaptive codebook energy based on the frame. For example, the adaptive codebook energy determination block/module 806 may determine the adaptive codebook energy based on an adaptive codebook contribution of the frame.

The fixed codebook energy determination block/module 810 may determine a fixed codebook energy based on the frame. For example, the fixed codebook energy determination block/module 810 may determine the fixed codebook energy of a fixed codebook contribution of the frame.

The redundancy coder 814 may code (e.g., generate) a redundant version of the frame based on the adaptive codebook energy and the fixed codebook energy. For example, the redundancy coder 814 may code the frame into a redundant version of the frame based on the adaptive codebook energy and the fixed codebook energy. The redundancy coder 814 may include a factor determination block/module 828 and/or an optional parameter skip determination block/module 830.

The factor determination block/module 828 may determine a factor in accordance with one or more of the approaches described herein (e.g., as described in one or more of FIG. 4 and FIG. 6). For example, the factor determination block/module 828 may determine the factor based on the adaptive codebook energy and the fixed codebook energy. For instance, the factor may be a ratio of the adaptive codebook energy and the fixed codebook energy or the factor M described above, etc. The electronic device 802 may determine which parameter(s) to code (e.g., a coding scheme) for the redundant version of the frame based on the factor.

The optional parameter skip determination block/module 830 may determine whether to skip coding of one or more parameters of one or more sub-frames for the redundant version of the frame. For example, in the case that a mixed coding scheme is determined, the parameter skip determination block/module 830 may determine to skip coding of one or more parameters for one or more sub-frames for the redundant version of the frame. This may be done on a fixed basis or an adaptive basis. For example, the parameter skip determination block/module 830 may make this determination as described above in connection with one or more of FIG. 6 and FIG. 7.

The redundancy insertion block/module 832 may insert the redundant version of the frame into a subsequent frame. For example, the redundancy insertion block/module 832 may insert one or more coded parameters of the redundant version of the frame into the subsequent frame. The subsequent frame may or may not immediately follow the frame. For example, the subsequent frame may be the next frame after the first frame. Alternatively, one or more other frames (or sub-frames) may occur between the first frame and the subsequent frame.

In some configurations, the electronic device 802 may transmit the frame (e.g., part of the coded audio signal 836) to another device. If the frame is unsuccessfully received (e.g., not received or received with errors) by the other device, the other device may reconstruct the frame based on the redundant version of the frame. For example, the other device may reconstruct the frame based on the redundant version of the frame received with the subsequent frame. This approach may reduce capacity lost due to retransmissions. Additionally or alternatively, the redundant version of the frame may beneficially increase the likelihood of successful decoding by the other device. It should be noted that the electronic device 802 may perform one or more of the functions or procedures described in connection with FIG. 8 on a sub-frame basis.

Figure 9:
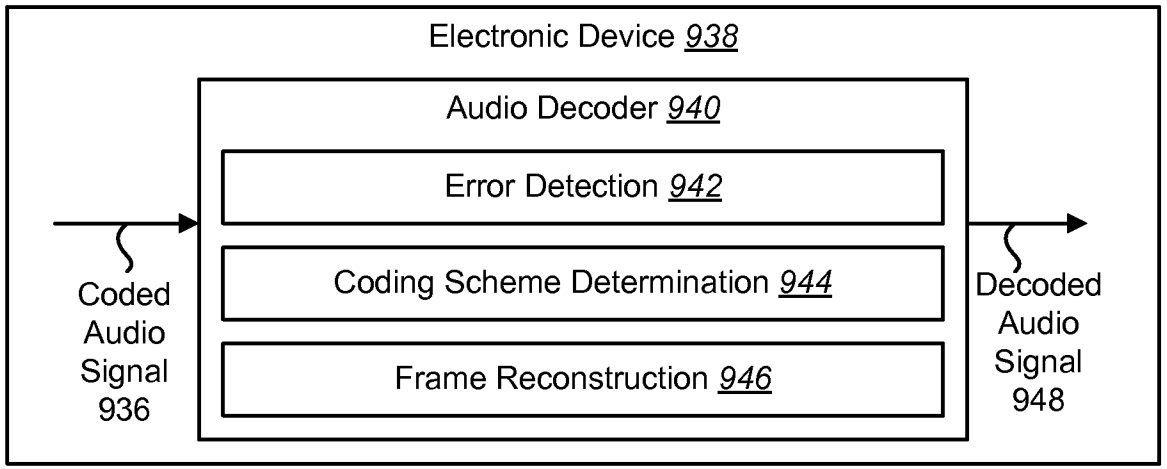
FIG. 9 is a block diagram illustrating one configuration of an electronic device in which systems and methods for redundant frame decoding may be implemented.

FIG. 9 is a block diagram illustrating one configuration of an electronic device 938 in which systems and methods for redundant frame decoding may be implemented. Examples of the electronic device 938 include wireless communication devices (e.g., cellular phones, smart phones, personal digital assistants (PDAs), laptop computers, e-readers, etc.), desktop computers, telephones, audio recorders, game consoles, televisions and other devices. The electronic device 938 includes an audio decoder 940. The audio decoder 940 may obtain a coded audio signal 936 (e.g., coded frames). The audio decoder 940 may decode the coded audio signal 936 into a decoded audio signal 948. The audio decoder 940 may include an error detection block/module 942, a coding scheme determination block/module 944 and/or a frame reconstruction block/module 946.

As used herein, a "block/module" may be implemented in hardware (e.g., circuitry), software or a combination of both. Furthermore, one or more of the elements included within the electronic device 938 may be implemented in hardware (e.g., circuitry), software or a combination of both. For example, the audio decoder 940 may be implemented in hardware, software or a combination of both. It should be noted that one or more of the elements depicted in the electronic device 938 may be coupled together. For example, the error detection block/module 942 may be coupled to the coding scheme determination block/module 944, which may be coupled to the frame reconstruction block/module 946 in some configurations.

The error detection block/module 942 may detect when a frame is unsuccessfully received. For example, the error detection block/module 942 may detect when a frame was not received or was received with errors. In some configurations, the error detection block/module 942 may make this determination based on an indicator from a channel decoder that indicates that a packet was unsuccessfully received.

The coding scheme determination block/module 944 may determine a coding scheme used to code the redundant version of a frame. For example, the coding scheme determination block/module 944 may determine whether the redundant version of a frame includes one or more adaptive codebook parameters (e.g., pitch lag, pitch gain), one or more fixed codebook parameters (e.g., fixed codebook pulses, fixed codebook gain) or both. This may be done, for example, when the error detection block/module 942 determines that a frame was unsuccessfully received. In some configurations, this determination may be made based on explicit signaling, based on implicit signaling and/or based on analyzing a frame. For example, the electronic device (e.g., receiver) may include a de-jitter buffer that stores received packets. If a particular frame N is lost, then the de-jitter buffer is checked to see if frame N+OFFSET (where OFFSET may be a forward error correction frame offset, for example) is available in the buffer or not. If so, frame N+OFFSET is analyzed to determine if it contains a partial copy (e.g., redundant version) of lost frame N (by analyzing the bit-stream, for instance). If yes, then the redundant frame coding mode/scheme may be determined by further analyzing the bit-stream. For example, one or more bits may be reserved to convey this information to the decoder. In particular, an electronic device (e.g., decoder) may determine the coding scheme based on one or more received coding scheme bits. The coding scheme bits may indicate adaptive codebook parameter(s) only (e.g., an adaptive codebook-only coding scheme), fixed codebook parameter(s) only (e.g., a fixed codebook-only coding scheme) or both adaptive codebook parameter(s) and fixed codebook parameter(s). It should be noted that individual sub-frames may each have a separate coding scheme in some configurations. Accordingly, the coding scheme determination 944 may be performed on each sub-frame in some implementations. In some configurations, the coding scheme determination block/module 944 may determine a size of the redundant version of the frame (when the size is variable, for example).

The frame reconstruction block/module 946 may reconstruct an unsuccessfully received frame based on the redundant version of the frame. In some configurations, the frame reconstruction block/module 946 may decode the parameter (s) included in the redundant version of the frame (that is included in a subsequent frame, for example). For example, the frame reconstruction block/module 946 may decode one or more parameters as indicated by the coding scheme. In some configurations and/or cases, the frame reconstruction block/module 946 may reconstruct one or more sub-frames by extrapolating one or more previous sub-frames (when the coding of one or more parameters for one or more sub-frames has been skipped, for example).

In some implementations, the audio decoder 940 may be implemented in combination with one or more of the elements illustrated in one or more of FIG. 1 and FIG. 8. For example, the audio decoder 940 and the audio coder 824 described in connection with FIG. 8 may be implemented in the same electronic device in some configurations. For instance, the audio decoder 940 and the audio coder 824 may be implemented in an audio codec on an electronic device. In particular, an audio coder 824 may code audio signals 834 that may be transmitted and/or stored in memory on an electronic device. The audio decoder 940 may decode coded audio signals 936 received from another device and/or coded audio signals 936 stored in memory on the electronic device. It should be noted that the electronic device 938 may perform one or more of the functions or procedures described in connection with FIG. 9 on a sub-frame basis.

Figure 10:
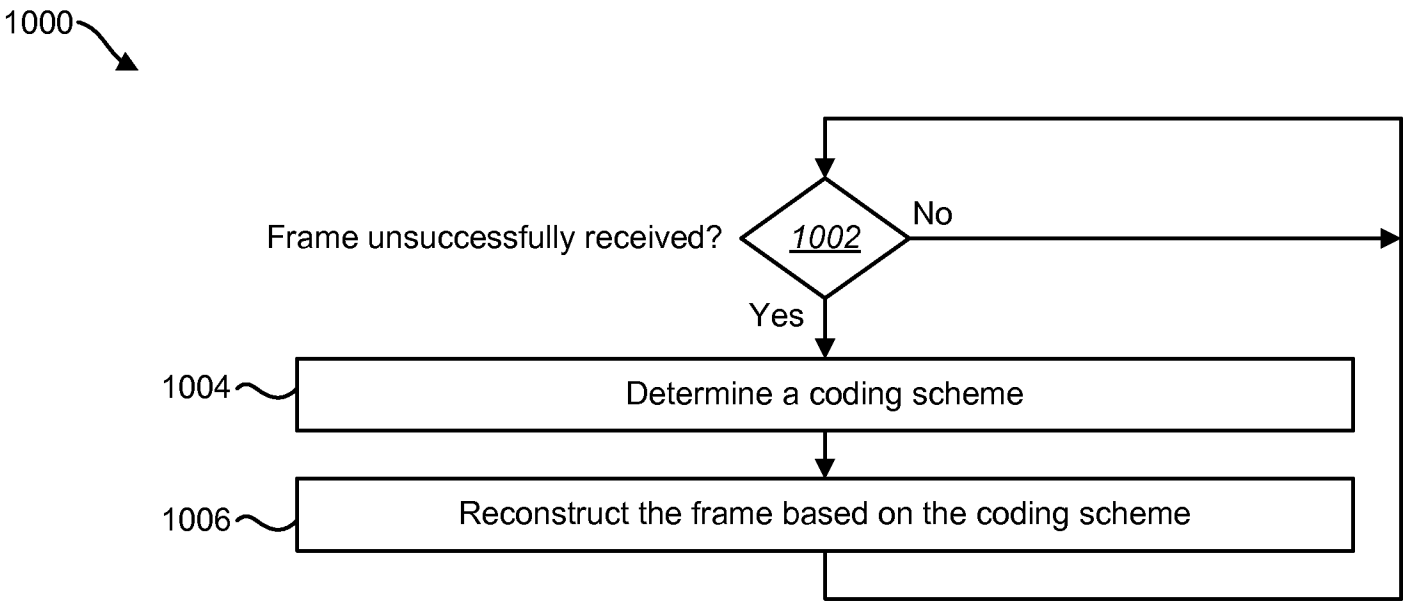
FIG. 10 is a flow diagram illustrating one configuration of a method for redundant frame decoding.

FIG. 10 is a flow diagram illustrating one configuration of a method 1000 for redundant frame decoding. An electronic device 938 may determine 1002 (e.g., detect) whether a frame (or sub-frame) is unsuccessfully received. For example, the electronic device 938 may determine whether a frame (or sub-frame) is not received or was received with errors. In some configurations, this determination 1002 may be made based on an indicator from channel decoding that indicates that a packet was unsuccessfully received. If the electronic device 938 determines that a frame (or sub-frame) was received successfully, then the electronic device 938 may determine 1002 whether a next frame or sub-frame (if any) was unsuccessfully received.

In some configurations, the electronic device may also determine whether a redundant version of the frame is available. For example, the electronic device 938 may check a de-jitter buffer to determine whether frame N+OFFSET is available. If frame N+OFFSET is available, the electronic device 938 may determine whether it includes a redundant version of the unsuccessfully received frame (e.g., frame N).

If the electronic device 938 determines 1002 that the frame or sub-frame was unsuccessfully received (and that a redundant version of the frame is available, for example), the electronic device may determine 1004 a coding scheme used to code the redundant version of a frame. For example, the electronic device 938 may determine whether the redundant version of the frame includes only (one or more) fixed codebook parameters, only (one or more) adaptive codebook parameters or (one or more) adaptive codebook parameters and (one or more) fixed codebook parameters. For instance, the electronic device 938 may determine whether the redundant version of a frame includes one or more adaptive codebook parameters (e.g., pitch lag, pitch gain), one or more fixed codebook parameters (e.g., fixed codebook pulses, fixed codebook gain) or both.

In some configurations, this determination 1004 may be made based on explicit signaling, based on implicit signaling and/or based on analyzing a frame. It should be noted that individual sub-frames may each have a separate coding scheme in some configurations. Accordingly, the electronic device 938 may determine 1004 the coding scheme for each sub-frame in some implementations. In some configurations, the electronic device 938 may also determine a size of the redundant version of the frame (when the size is variable, for example).

The electronic device 938 may reconstruct 1006 the frame (e.g., the unsuccessfully received frame) based on the coding scheme. In some configurations, the electronic device 938 may decode the parameter(s) included in the redundant version of the frame (that is included in a subsequent frame, for example). For example, the electronic device 938 may decode one or more parameters as indicated by the coding scheme. In some configurations and/or cases, the electronic device 938 may reconstruct 1006 one or more sub-frames by extrapolating one or more previous sub-frames (when the coding of one or more parameters for one or more sub-frames has been skipped, for example). It should be noted that the electronic device 938 may perform one or more of the functions or procedures in the method 1000 on a sub-frame basis.

Figure 11:
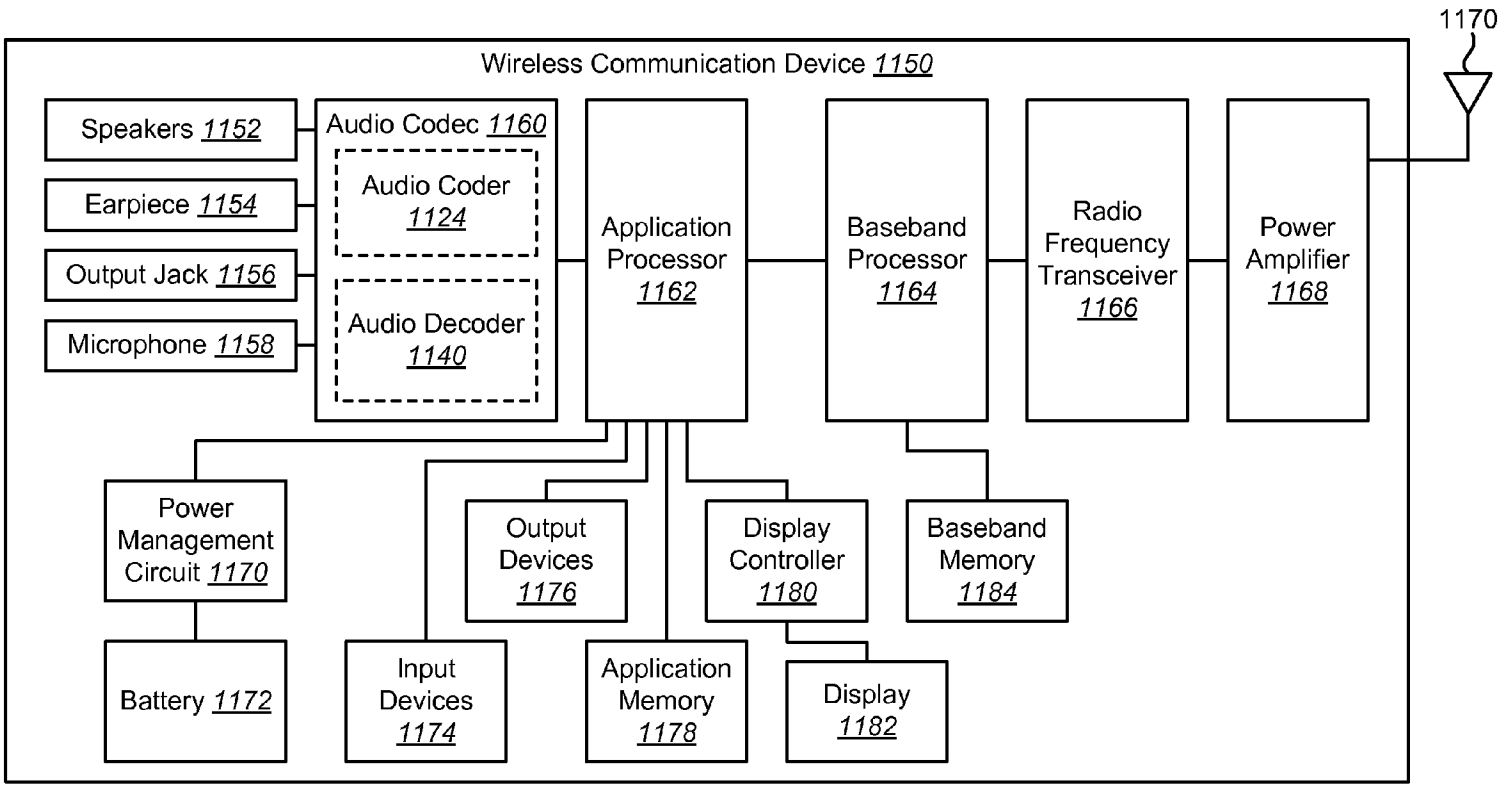
FIG. 11 is a block diagram illustrating one configuration of a wireless communication device in which systems and methods for redundant frame coding and/or decoding may be implemented.

FIG. 11 is a block diagram illustrating one configuration of a wireless communication device 1150 in which systems and methods for redundant frame coding and/or decoding may be implemented. The wireless communication device 1150 illustrated in FIG. 11 may be an example of one or more of the electronic devices 102, 802, 938, 1250 described herein. The wireless communication device 1150 may include an application processor 1162. The application processor 1162 generally processes instructions (e.g., runs programs) to perform functions on the wireless communication device 1150. The application processor 1162 may be coupled to an audio coder/decoder (codec) 1160.

The audio codec 1160 may be an electronic device (e.g., integrated circuit) used for coding and/or decoding audio signals. The audio codec 1160 may be coupled to one or more speakers 1152, an earpiece 1154, an output jack 1156 and/or one or more microphones 1158. The speakers 1152 may include one or more electro-acoustic transducers that convert electrical or electronic signals into acoustic signals. For example, the speakers 1152 may be used to play music or output a speakerphone conversation, etc. The earpiece 1154 may be another speaker or electro-acoustic transducer that can be used to output acoustic signals (e.g., speech signals) to a user. For example, the earpiece 1154 may be used such that only a user may reliably hear the acoustic signal. The output jack 1156 may be used for coupling other devices to the wireless communication device 1150 for outputting audio, such as headphones. The speakers 1152, earpiece 1154 and/or output jack 1156 may generally be used for outputting an audio signal from the audio codec 1160. The one or more microphones 1158 may be acousto-electric transducer that converts an acoustic signal (such as a user's voice) into electrical or electronic signals that are provided to the audio codec 1160.

The audio codec 1160 may include an audio coder 1124 and/or an audio decoder 1140. The audio coder 1124 may be configured similarly to the audio coder 824 described in connection with FIG. 8 and/or may include one or more of the elements described in connection with FIG. 1 and/or FIG. 8. Additionally or alternatively, the audio coder 1124 may perform one or more of the methods 200, 400, 500, 600 and/or one or more of the functions described in connection with one or more of the methods 200, 400, 500, 600 described above. The audio decoder 1140 may be configured similarly to the audio decoder 940 described in connection with FIG. 9 and/or may include one or more of the elements described in connection with FIG. 9. Additionally or alternatively, the audio decoder 1140 may perform the method 1000 and/or one or more of the functions described in connection with the method 1000 described above. Additionally or alternatively, the audio coder 1124 and/or the audio decoder 1140 may be included in the application processor 1162. Additionally or alternatively, one or more of the functions performed by the audio coder 1124 and/or audio decoder 1140 may be performed by the application processor 1162.

The application processor 1162 may also be coupled to a power management circuit 1170. One example of a power management circuit 1170 is a power management integrated circuit (PMIC), which may be used to manage the electrical power consumption of the wireless communication device 1150. The power management circuit 1170 may be coupled to a battery 1172. The battery 1172 may generally provide electrical power to the wireless communication device 1150. For example, the battery 1172 and/or the power management circuit 1170 may be coupled to one or more of the elements included in the wireless communication device 1150.

The application processor 1162 may be coupled to one or more input devices 1174 for receiving input. Examples of input devices 1174 include infrared sensors, image sensors, accelerometers, touch sensors, keypads, etc. The input devices 1174 may allow user interaction with the wireless communication device 1150. The application processor 1162 may also be coupled to one or more output devices 1176. Examples of output devices 1176 include printers, projectors, screens, haptic devices, etc. The output devices 1176 may allow the wireless communication device 1150 to produce output that may be experienced by a user.

The application processor 1162 may be coupled to application memory 1178. The application memory 1178 may be any electronic device that is capable of storing electronic information. Examples of application memory 1178 include double data rate synchronous dynamic random access memory (DDRAM), synchronous dynamic random access memory (SDRAM), flash memory, etc. The application memory 1178 may provide storage for the application processor 1162. For instance, the application memory 1178 may store data and/or instructions for the functioning of programs that are run on the application processor 1162.

The application processor 1162 may be coupled to a display controller 1180, which in turn may be coupled to a display 1182. The display controller 1180 may be a hardware block that is used to generate images on the display 1182. For example, the display controller 1180 may translate instructions and/or data from the application processor 1162 into images that can be presented on the display 1182. Examples of the display 1182 include liquid crystal display (LCD) panels, light emitting diode (LED) panels, cathode ray tube (CRT) displays, plasma displays, etc.

The application processor 1162 may be coupled to a baseband processor 1164. The baseband processor 1164 generally processes communication signals. For example, the baseband processor 1164 may demodulate and/or decode received signals. Additionally or alternatively, the baseband processor 1164 may encode and/or modulate signals in preparation for transmission.

The baseband processor 1164 may be coupled to baseband memory 1184. The baseband memory 1184 may be any electronic device capable of storing electronic information, such as SDRAM, DDRAM, flash memory, etc. The baseband processor 1164 may read information (e.g., instructions and/or data) from and/or write information to the baseband memory 1184. Additionally or alternatively, the baseband processor 1164 may use instructions and/or data stored in the baseband memory 1184 to perform communication operations.

The baseband processor 1164 may be coupled to a radio frequency (RF) transceiver 1166. The RF transceiver 1166 may be coupled to a power amplifier 1168 and one or more antennas 1109. The RF transceiver 1166 may transmit and/or receive radio frequency signals. For example, the RF transceiver 1166 may transmit an RF signal using a power amplifier 1168 and one or more antennas 1109. The RF transceiver 1166 may also receive RF signals using the one or more antennas 1109.

Figure 12:
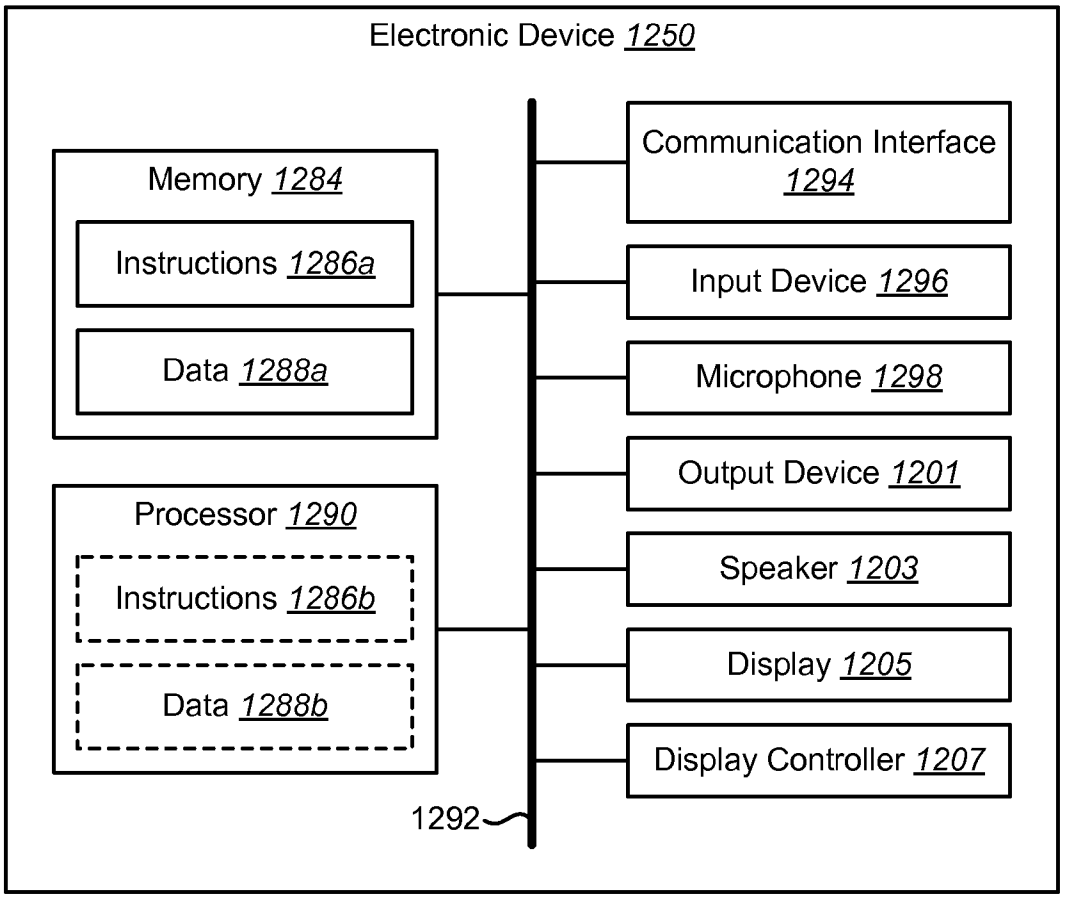
FIG. 12 illustrates various components that may be utilized in an electronic device.

FIG. 12 illustrates various components that may be utilized in an electronic device 1250. The illustrated components may be located within the same physical structure or in separate housings or structures. The electronic device 1250 described in connection with FIG. 12 may be implemented in accordance with one or more of the electronic devices 102, 802, 938 and the wireless communication device 1150 described herein. The electronic device 1250 includes a processor 1290. The processor 1290 may be a general purpose single- or multi-chip microprocessor (e.g., an ARM), a special purpose microprocessor (e.g., a digital signal processor (DSP)), a microcontroller, a programmable gate array, etc. The processor 1290 may be referred to as a central processing unit (CPU). Although just a single processor 1290 is shown in the electronic device 1250 of FIG. 12, in an alternative configuration, a combination of processors (e.g., an ARM and DSP) could be used.

The electronic device 1250 also includes memory 1284 in electronic communication with the processor 1290. That is, the processor 1290 can read information from and/or write information to the memory 1284. The memory 1284 may be any electronic component capable of storing electronic information. The memory 1284 may be random access memory (RAM), read-only memory (ROM), magnetic disk storage media, optical storage media, flash memory devices in RAM, on-board memory included with the processor, programmable read-only memory (PROM), erasable programmable read-only memory (EPROM), electrically erasable PROM (EEPROM), registers, and so forth, including combinations thereof.

Data 1288*a* and instructions 1286*a* may be stored in the memory 1284. The instructions 1286*a* may include one or more programs, routines, sub-routines, functions, procedures, etc. The instructions 1286*a* may include a single computer-readable statement or many computer-readable statements. The instructions 1286*a* may be executable by the processor 1290 to implement one or more of the methods 200, 400, 500, 600, 1000 described above. Executing the instructions 1286*a* may involve the use of the data 1288*a* that is stored in the memory 1284. FIG. 12 shows some instructions 1286*b* and data 1288*b* being loaded into the processor 1290 (which may come from instructions 1286*a* and data 1288*a*).

The electronic device 1250 may also include one or more communication interfaces 1294 for communicating with other electronic devices. The communication interfaces 1294 may be based on wired communication technology, wireless communication technology, or both. Examples of different types of communication interfaces 1294 include a serial port, a parallel port, a Universal Serial Bus (USB), an Ethernet adapter, an IEEE 1394 bus interface, a small computer system interface (SCSI) bus interface, an infrared (IR) communication port, a Bluetooth wireless communication adapter, and so forth.

The electronic device 1250 may also include one or more input devices 1296 and one or more output devices 1201. Examples of different kinds of input devices 1296 include a keyboard, mouse, microphone, remote control device, button, joystick, trackball, touchpad, lightpen, etc. For instance, the electronic device 1250 may include one or more microphones 1298 for capturing acoustic signals. In one configuration, a microphone 1298 may be a transducer that converts acoustic signals (e.g., voice, speech) into electrical or electronic signals. Examples of different kinds of output devices 1201 include a speaker, printer, etc. For instance, the electronic device 1250 may include one or more speakers 1203. In one configuration, a speaker 1203 may be a transducer that converts electrical or electronic signals into acoustic signals. One specific type of output device which may be typically included in an electronic device 1250 is a display device 1205. Display devices 1205 used with configurations disclosed herein may utilize any suitable image projection technology, such as a cathode ray tube (CRT), liquid crystal display (LCD), light-emitting diode (LED), gas plasma, electroluminescence, or the like. A display controller 1207 may also be provided, for converting data stored in the memory 1284 into text, graphics, and/or moving images (as appropriate) shown on the display device 1205.

The various components of the electronic device 1250 may be coupled together by one or more buses, which may include a power bus, a control signal bus, a status signal bus, a data bus, etc. For simplicity, the various buses are illustrated in FIG. 12 as a bus system 1292. It should be noted that FIG. 12 illustrates only one possible configuration of an electronic device 1250. Various other architectures and components may be utilized.

In the above description, reference numbers have sometimes been used in connection with various terms. Where a term is used in connection with a reference number, this may be meant to refer to a specific element that is shown in one or more of the Figures. Where a term is used without a reference number, this may be meant to refer generally to the term without limitation to any particular Figure.

The term "determining" encompasses a wide variety of actions and, therefore, "determining" can include calculating, computing, processing, deriving, investigating, looking up (e.g., looking up in a table, a database or another data structure), ascertaining and the like. Also, "determining" can include receiving (e.g., receiving information), accessing (e.g., accessing data in a memory) and the like. Also, "determining" can include resolving, selecting, choosing, establishing and the like.

The phrase "based on" does not mean "based only on," unless expressly specified otherwise. In other words, the phrase "based on" describes both "based only on" and "based at least on."

It should be noted that one or more of the features, functions, procedures, components, elements, structures, etc., described in connection with any one of the configurations described herein may be combined with one or more of the functions, procedures, components, elements, structures, etc., described in connection with any of the other configurations described herein, where compatible. In other words, any compatible combination of the functions, procedures, components, elements, etc., described herein may be implemented in accordance with the systems and methods disclosed herein.

The functions described herein may be stored as one or more instructions on a processor-readable or computer-readable medium. The term "computer-readable medium" refers to any available medium that can be accessed by a computer or processor. By way of example, and not limitation, such a medium may comprise RAM, ROM, EEPROM, flash memory, CD-ROM or other optical disk storage, magnetic disk storage or other magnetic storage devices, or any other medium that can be used to store desired program code in the form of instructions or data structures and that can be accessed by a computer. Disk and disc, as used herein, includes compact disc (CD), laser disc, optical disc, digital versatile disc (DVD), floppy disk and Blu-ray® disc where disks usually reproduce data magnetically, while discs reproduce data optically with lasers. It should be noted that a computer-readable medium may be tangible and non-transitory. The term "computer-program product" refers to a computing device or processor in combination with code or instructions (e.g., a "program") that may be executed, processed or computed by the computing device or processor. As used herein, the term "code" may refer to software, instructions, code or data that is/are executable by a computing device or processor.

Software or instructions may also be transmitted over a transmission medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of transmission medium.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims.

It is to be understood that the claims are not limited to the precise configuration and components illustrated above. Various modifications, changes and variations may be made in the arrangement, operation and details of the systems, methods, and apparatus described herein without departing from the scope of the claims.

What is claimed is:

1. A method for redundant frame coding by an electronic device, comprising:

determining an adaptive codebook energy and a fixed codebook energy based on a frame;

coding a redundant version of the frame based on the adaptive codebook energy and the fixed codebook energy; and sending a subsequent frame that comprises the redundant version of the frame.

2. The method of claim 1, wherein coding the redundant version of the frame based on the adaptive codebook energy and the fixed codebook energy comprises determining a factor based on the adaptive codebook energy and the fixed codebook energy.

3. The method of claim 2, wherein coding the redundant version of the frame based on the adaptive codebook energy and the fixed codebook energy further comprises determining whether the factor is below a first threshold, is between the first threshold and a second threshold or is above the second threshold.

4. The method of claim 3, wherein if the factor is below the first threshold, then coding the redundant version of the frame comprises coding only one or more fixed codebook parameters for the redundant version of the frame.

5. The method of claim 3, wherein if the factor is between the first threshold and second threshold, then coding the redundant version of the frame comprises coding one or more adaptive codebook parameters and one or more fixed codebook parameters for the redundant version of the frame.

6. The method of claim 5, wherein coding the redundant version of the frame comprises skipping coding of at least one parameter for at least one sub-frame of the frame.

7. The method of claim 5, wherein coding the redundant version of the frame further comprises determining one or more sub-frames for skipping coding of one or more parameters on a fixed basis or on an adaptive basis.

8. The method of claim 3, wherein if the factor is above the second threshold, then coding the redundant version of the frame comprises coding only one or more adaptive codebook parameters for the redundant version of the frame.

9. The method of claim 3, wherein the first threshold is 0.15 and the second threshold is 0.3.

10. The method of claim 2, wherein the factor is M in accordance with an equation $$M = \frac{\frac{E(ACB) + E(FCB)}{E(ACB) - E(FCB)} + 1}{4},$$

wherein E(ACB) is the adaptive codebook energy and E(FCB) is the fixed codebook energy.

11. The method of claim 1, wherein the frame is a sub-frame.

12. The method of claim 1, wherein a size of the redundant version of the frame is variable.

13. The method of claim 1, wherein coding the redundant version of the frame comprises selectively dropping one or more parameters from a primary bit-stream.

14. The method of claim 1, wherein coding the redundant version of the frame comprises redoing the encoding of the frame using fewer bits.

15. A method for redundant frame decoding by an electronic device, comprising:

determining whether a frame was unsuccessfully received;

determining a coding scheme by determining whether a redundant version of the frame includes only one or more adaptive codebook parameters, only one or more fixed codebook parameters, or one or more adaptive codebook parameters and one or more fixed codebook parameters if a frame was unsuccessfully received; and reconstructing the frame based on the coding scheme if a frame was unsuccessfully received.

16. The method of claim 15, wherein determining the coding scheme is based on one or more received coding scheme bits.

17. The method of claim 15, wherein reconstructing the frame is further based on the redundant version of the frame.

18. An electronic device for redundant frame coding, comprising:

adaptive codebook energy determination circuitry that determines an adaptive codebook energy based on a frame;

fixed codebook energy determination circuitry that determines a fixed codebook energy based on the frame;

a redundancy coder coupled to the adaptive codebook energy determination circuitry and to the fixed codebook energy determination circuitry, wherein the redundancy coder codes a redundant version of the frame based on the adaptive codebook energy and the fixed codebook energy; and transmission circuitry coupled to the redundancy coder, wherein the transmission circuitry sends a subsequent frame that comprises the redundant version of the frame.

19. The electronic device of claim 18, wherein coding the redundant version of the frame based on the adaptive codebook energy and the fixed codebook energy comprises determining a factor based on the adaptive codebook energy and the fixed codebook energy.

20. The electronic device of claim 19, wherein coding the redundant version of the frame based on the adaptive codebook energy and the fixed codebook energy further comprises determining whether the factor is below a first threshold, is between the first threshold and a second threshold or is above the second threshold.

21. The electronic device of claim 20, wherein if the factor is below the first threshold, then coding the redundant version of the frame comprises coding only one or more fixed codebook parameters for the redundant version of the frame.

22. The electronic device of claim 20, wherein if the factor is between the first threshold and second threshold, then coding the redundant version of the frame comprises coding one or more adaptive codebook parameters and one or more fixed codebook parameters for the redundant version of the frame.

23. The electronic device of claim 22, wherein coding the redundant version of the frame comprises skipping coding of at least one parameter for at least one sub-frame of the frame.

24. The electronic device of claim 22, wherein coding the redundant version of the frame further comprises determining one or more sub-frames for skipping coding of one or more parameters on a fixed basis or on an adaptive basis.

25. The electronic device of claim 20, wherein if the factor is above the second threshold, then coding the redundant version of the frame comprises coding only one or more adaptive codebook parameters for the redundant version of the frame.

26. The electronic device of claim 20, wherein the first threshold is 0.15 and the second threshold is 0.3.

27. The electronic device of claim 19, wherein the factor is M in accordance with an equation $$M = \frac{\frac{E(ACB) + E(FCB)}{E(ACB) - E(FCB)} + 1}{4},$$

wherein E(ACB) is the adaptive codebook energy and E(FCB) is the fixed codebook energy.

28. The electronic device of claim 18, wherein the frame is a sub-frame.

29. The electronic device of claim 18, wherein a size of the redundant version of the frame is variable.

30. The electronic device of claim 18, wherein coding the redundant version of the frame comprises selectively dropping one or more parameters from a primary bit-stream.

31. The electronic device of claim 18, wherein coding the redundant version of the frame comprises redoing the encoding of the frame using fewer bits.

32. An electronic device for redundant frame decoding, comprising:

error detection circuitry that determines whether a frame was unsuccessfully received;

coding scheme determination circuitry coupled to the error detection circuitry, wherein the coding scheme determination circuitry determines a coding scheme by determining whether a redundant version of the frame includes only one or more adaptive codebook parameters, only one or more fixed codebook parameters, or one or more adaptive codebook parameters and one or more fixed codebook parameters if a frame was unsuccessfully received; and frame reconstruction circuitry coupled to the coding scheme determination circuitry, wherein the frame reconstruction circuitry reconstructs the frame based on the coding scheme if a frame was unsuccessfully received.

33. The electronic device of claim 32, wherein determining the coding scheme is based on one or more received coding scheme bits.

34. The electronic device of claim 32, wherein reconstructing the frame is further based on the redundant version of the frame.

35. A computer-program product for redundant frame coding, comprising a non-transitory tangible computer-readable medium having instructions thereon, the instructions comprising:

code for causing an electronic device to determine an adaptive codebook energy and a fixed codebook energy based on a frame;

code for causing the electronic device to code a redundant version of the frame based on the adaptive codebook energy and the fixed codebook energy; and code for causing the electronic device to send a subsequent frame that comprises the redundant version of the frame.

36. The computer-readable medium of claim 35, wherein the code for causing the electronic device to code the redundant version of the frame based on the adaptive codebook energy and the fixed codebook energy comprises code for causing the electronic device to determine a factor based on the adaptive codebook energy and the fixed codebook energy.

37. The computer-readable medium of claim 36, wherein the code for causing the electronic device to code the redundant version of the frame based on the adaptive codebook energy and the fixed codebook energy further comprises code for causing the electronic device to determine whether the factor is below a first threshold, is between the first threshold and a second threshold or is above the second threshold.

38. The computer-readable medium of claim 37, wherein if the factor is below the first threshold, then the code for causing the electronic device to code the redundant version of the frame comprises code for causing the electronic device to code only one or more fixed codebook parameters for the redundant version of the frame.

39. The computer-readable medium of claim 37, wherein if the factor is between the first threshold and second threshold, then the code for causing the electronic device to code the redundant version of the frame comprises code for causing the electronic device to code one or more adaptive codebook parameters and one or more fixed codebook parameters for the redundant version of the frame.

40. The computer-readable medium of claim 39, wherein the code for causing the electronic device to code the redundant version of the frame comprises code for causing the electronic device to skip coding of at least one parameter for at least one sub-frame of the frame.

41. The computer-readable medium of claim 37, wherein if the factor is above the second threshold, then the code for causing the electronic device to code the redundant version of the frame comprises code for causing the electronic device to code only one or more adaptive codebook parameters for the redundant version of the frame.

42. The computer-readable medium of claim 35, wherein the frame is a sub-frame.

43. The computer-readable medium of claim 35, wherein a size of the redundant version of the frame is variable.

44. A computer-program product for redundant frame decoding, comprising a non-transitory tangible computer-readable medium having instructions thereon, the instructions comprising:

code for causing an electronic device to determine whether a frame was unsuccessfully received;

code for causing the electronic device to determine a coding scheme by determining whether a redundant version of the frame includes only one or more adaptive codebook parameters, only one or more fixed codebook parameters, or one or more adaptive codebook parameters and one or more fixed codebook parameters if a frame was unsuccessfully received; and code for causing the electronic device to reconstruct the frame based on the coding scheme if a frame was unsuccessfully received.

45. The computer-program product of claim 44, wherein determining the coding scheme is based on one or more received coding scheme bits.

46. The computer-program product of claim 44, wherein reconstructing the frame is further based on the redundant version of the frame.

47. An apparatus for redundant frame coding, comprising:

means for determining an adaptive codebook energy and a fixed codebook energy based on a frame;

means for coding a redundant version of the frame based on the adaptive codebook energy and the fixed codebook energy; and means for sending a subsequent frame that comprises the redundant version of the frame.

48. The apparatus of claim 47, wherein the means for coding the redundant version of the frame based on the adaptive codebook energy and the fixed codebook energy comprises means for determining a factor based on the adaptive codebook energy and the fixed codebook energy.

49. The apparatus of claim 48, wherein the means for coding the redundant version of the frame based on the adaptive codebook energy and the fixed codebook energy further comprises means for determining whether the factor is below a first threshold, is between the first threshold and a second threshold or is above the second threshold.

50. The apparatus of claim 49, wherein if the factor is below the first threshold, then the means for coding the redundant version of the frame comprises means for coding only one or more fixed codebook parameters for the redundant version of the frame.

51. The apparatus of claim 49, wherein if the factor is between the first threshold and second threshold, then the means for coding the redundant version of the frame comprises means for coding one or more adaptive codebook parameters and one or more fixed codebook parameters for the redundant version of the frame.

52. The apparatus of claim 51, wherein the means for coding the redundant version of the frame comprises means for skipping coding of at least one parameter for at least one sub-frame of the frame.

53. The apparatus of claim 49, wherein if the factor is above the second threshold, then the means for coding the redundant version of the frame comprises means for coding only one or more adaptive codebook parameters for the redundant version of the frame.

54. The apparatus of claim 47, wherein the frame is a sub-frame.

55. The apparatus of claim 47, wherein a size of the redundant version of the frame is variable.

56. An apparatus for redundant frame decoding, comprising:

means for determining whether a frame was unsuccessfully received;

means for determining a coding scheme by determining whether a redundant version of the frame includes only one or more adaptive codebook parameters, only one or more fixed codebook parameters, or one or more adaptive codebook parameters and one or more fixed codebook parameters if a frame was unsuccessfully received; and means for reconstructing the frame based on the coding scheme if a frame was unsuccessfully received.

57. The apparatus of claim 56, wherein determining the coding scheme is based on one or more received coding scheme bits.

58. The apparatus of claim 56, wherein reconstructing the frame is further based on the redundant version of the frame.

* * * * *